US011548670B2

(12) United States Patent
Castellari et al.

(10) Patent No.: US 11,548,670 B2
(45) Date of Patent: Jan. 10, 2023

(54) UNIT AND METHOD FOR FILLING CONTAINING ELEMENTS OF SINGLE-USE CAPSULES FOR EXTRACTION OR INFUSION BEVERAGES

(71) Applicant: GIMA S.p.A., Bologna (IT)

(72) Inventors: Pierluigi Castellari, Bologna (IT); Dario Rea, Bologna (IT)

(73) Assignee: GIMA S.p.A., Bologna (IT)

( * ) Notice: Subject to any disclaimer, the term of this patent is extended or adjusted under 35 U.S.C. 154(b) by 442 days.

(21) Appl. No.: 15/324,531

(22) PCT Filed: Jul. 1, 2015

(86) PCT No.: PCT/IB2015/054966
§ 371 (c)(1),
(2) Date: Jan. 6, 2017

(87) PCT Pub. No.: WO2016/005861
PCT Pub. Date: Jan. 14, 2016

(65) Prior Publication Data

US 2018/0178936 A1 Jun. 28, 2018

(30) Foreign Application Priority Data

Jul. 8, 2014 (IT) ..... BO2014A0382

(51) Int. Cl.
*B65B 29/02* (2006.01)
*B65B 1/12* (2006.01)
(Continued)

(52) U.S. Cl.
CPC ..... *B65B 29/022* (2017.08); *B65B 1/12* (2013.01); *B65B 1/24* (2013.01); *B65B 1/30* (2013.01);
(Continued)

(58) Field of Classification Search
CPC ..... B65B 29/00; B65B 29/02; B65B 29/022; B65B 1/12; B65B 1/24; B65B 1/30; B65B 1/363; B65B 1/385; B65B 63/022
(Continued)

(56) References Cited

U.S. PATENT DOCUMENTS 2,196,403 A * 4/1940 Thompson ..... B65B 39/145 141/9
2,330,361 A * 9/1943 Howard ..... B65B 9/087 53/455
(Continued)

FOREIGN PATENT DOCUMENTS

CN 2142437 Y 9/1993
CN 1483646 A 3/2004
(Continued)

OTHER PUBLICATIONS

Notice of the first Chinese Office Action corresponding to Application/Patent No. 201580037118.4 dated Jun. 4, 2018.
(Continued)

*Primary Examiner* — Thomas M Wittenschlaeger
*Assistant Examiner* — David G Shutty
(74) *Attorney, Agent, or Firm* — Renner, Otto, Bolsselle & Sklar, LLP

(57) ABSTRACT

Described is a unit for filling containing elements (2) of single-use capsules (3) with a dose (33) of product for extraction or infusion beverages, comprising: a line (4) for transporting containing elements (2); a station (SR) for filling the containing elements (2) with a dose (33) of product which comprises: at least a first containing seat (S1) designed to receive a dose (33) of product; a substation (ST1) for forming the dose (33) provided with a device (6) for releasing a predetermined quantity of product defining the dose (33) inside the first containing seat (S1), the release
(Continued)

device (6) comprising a hopper (38) and at least one rotary element (40*a*) having a helical profile which extends between a first end and a second end, configured to rotate about a respective axis (X4) of rotation; a drive and control unit (15) configured to drive the rotary element (40*a*) according to a speed of rotation variable as a function of an angular position of the first end of the rotary unit (40*a*).

18 Claims, 10 Drawing Sheets

(51) Int. Cl.
*B65B 1/24* (2006.01)
*B65B 1/38* (2006.01)
*B65B 1/30* (2006.01)
*B65B 1/36* (2006.01)
*B65B 63/02* (2006.01)

(52) U.S. Cl.
CPC ..... *B65B 1/363* (2013.01); *B65B 1/385* (2013.01); *B65B 63/022* (2013.01)

(58) Field of Classification Search
USPC ..... 198/625, 662, 669; 53/529
See application file for complete search history.

(56) References Cited

U.S. PATENT DOCUMENTS 2,716,510 A * 8/1955 Massmann ..... F04B 15/023 222/227
3,179,041 A * 4/1965 Luthi ..... B65B 39/145 100/223
3,213,901 A * 10/1965 Luthi ..... B65B 63/022 141/12
4,012,889 A * 3/1977 Chung ..... B65B 1/02 53/558
4,024,694 A * 5/1977 Cooper ..... B65B 1/02 53/282
4,326,568 A * 4/1982 Burton ..... B65B 39/145 141/114
4,590,977 A * 5/1986 Schmidt ..... B65B 1/12 141/129
4,747,250 A * 5/1988 Rossi ..... B65B 9/042 53/511
4,771,915 A * 9/1988 Cand ..... G01F 11/46 222/56
4,991,632 A * 2/1991 Nordmeyer ..... B65B 1/36 141/1
5,041,297 A * 8/1991 Dowaliby ..... B65B 1/36 426/397
5,409,137 A * 4/1995 Bonomelli ..... B65B 29/028 222/56
5,791,127 A * 8/1998 Rossi ..... B65B 1/363 53/559
5,855,233 A * 1/1999 Bolelli ..... A61J 3/074 141/144
6,050,456 A 4/2000 Soper
6,298,751 B1 * 10/2001 Ide ..... B29C 48/252 74/665 GA
6,425,422 B1 * 7/2002 Trebbi ..... A61J 3/074 141/67
7,610,735 B2 * 11/2009 Monti ..... B65B 5/103 53/244
8,136,706 B2 * 3/2012 Jung ..... B65G 65/46 222/413
2002/0063040 A1 * 5/2002 Lepage ..... B65G 33/08 198/662
2004/0020941 A1 * 2/2004 Engesser ..... B65G 33/18 222/135
2008/0115462 A1 * 5/2008 Doyle ..... B65B 3/24 53/459
2008/0283144 A1 * 11/2008 Rapparini ..... B30B 11/12 141/73
2011/0146840 A1 6/2011 Ansaloni et al.
2012/0210675 A1 * 8/2012 Murray ..... B65B 31/042 53/403
2013/0105277 A1 5/2013 Uno et al.
2014/0000758 A1 * 1/2014 Kuhn ..... B65B 1/12 141/37
2016/0067223 A1 3/2016 Vuagniaux et al.

FOREIGN PATENT DOCUMENTS

DE 3303655 A1 * 9/1983 ..... B65G 65/463
DE 19719339 C1 * 9/1998 ..... B65B 1/00
ES 2421062 A * 8/2013 ..... B65B 1/12
FR 2 566 120 A1 12/1985
GB 413213 A * 7/1934 ..... B65B 43/54
GB 672945 A * 5/1952 ..... B65B 1/385
JP 2003-146310 * 5/2003 ..... B65B 37/10
JP 2003-146310 A * 5/2003 ..... B65B 1/385
JP 2003-146310 A * 5/2003 ..... B65B 1/385
JP 2003146310 A * 5/2003 ..... B65B 43/54
JP 2007513024 A 5/2007
WO 92/20579 A1 11/1992
WO 01/34475 A1 5/2001
WO 2013/144837 A1 10/2013

OTHER PUBLICATIONS

International Search Report and Written Opinion for corresponding Patent Application No. PCT/IB2015/054966 dated Sep. 10, 2015.
Search Report for corresponding Italian Patent Application No. BO20140382 dated Mar. 24, 2015.

* cited by examiner

UNIT AND METHOD FOR FILLING CONTAINING ELEMENTS OF SINGLE-USE CAPSULES FOR EXTRACTION OR INFUSION BEVERAGES

This application is a national phase of International Application No. PCT/IB2015/054966 filed Jul. 1, 2015 and published in the English language, which claims priority to Italian Patent Application No. BO2014A000382 filed Jul. 8, 2014, which are hereby incorporated herein by reference in their entirety.

TECHNICAL FIELD

This invention relates to a unit and a method for filling containing elements of single-use capsules for extraction or infusion beverages with a dose of product.

BACKGROUND ART

The prior art capsules, used in machines for making extraction or infusion beverages, comprise in their simplest form, the following:

- a rigid, cup-shaped outer container comprising a perforatable or perforated bottom and an upper aperture provided with a rim (and usually, but not necessarily, having the shape of a truncated cone);
- a dose of product for extract or infusion beverages contained in the outer container;
- and a length of sheet obtained from a web for sealing (hermetically) the aperture of the rigid container and designed (usually but not necessarily) to be perforated by a nozzle which supplies liquid under pressure.

Usually, but not necessarily, the sealing sheet is obtained from a web of flexible material.

In some cases, the capsules may comprise one or more rigid or flexible filtering elements.

For example, a first filter (if present) may be located on the bottom of the rigid container.

A second filter (if present) may be interposed between the piece of sealing sheet and the product dose.

The dose of product may be in direct contact with the rigid, cup-shaped outer container, or with a filtering element.

The capsule made up in this way is received and used in specific slots in machines for making beverages.

In the technical sector in question, the need is particularly felt for filling in a simple and effective way the rigid, cup-shaped containers or the filtering elements whilst at the same time maintaining a high productivity.

A technical problem particularly felt in the sector in question is also that of filling the rigid, cup-shaped containers with the same predetermined quantity of product, that is to say, that of reducing the variability of the weight of product introduced in the rigid, cup-shaped containers (relative to each other).

This problem is in fact particularly felt by the final users of these machines (capsule manufacturers), who have the absolute necessity to produce capsules all filled with the same predetermined quantity of product; that is, they have the absolute need to reduce the variability of the weight of product between the capsules (statistically reducing the variability of the weight between the various capsules).

It should be noted that, in this regard, there are prior art packaging machines having a filling unit which allows the simultaneous filling of several parallel rows of rigid, cup-shaped containers, which are advancing. In this case, each row of rigid, cup-shaped containers is associated with a dedicated filling device, generally equipped with a screw feeder to allow the descent of the product inside the container.

This type of unit is therefore obviously quite expensive and complex, since it comprises a plurality of devices and drives (one for each screw device) which are independent from each other and which must necessarily be coordinated.

Moreover, the overall reliability of the machine resulting from this configuration/arrangement of elements is necessarily limited because the rate of faults is inevitably linked with the number of devices and drives present.

Moreover, the screw feeder devices may have drawbacks due to clogging, soiling and poor dosing accuracy. More in detail, the end part of the screw feeder is not normally able to retain the product, which therefore falls and soils the machine.

It has also been found, in particular with screw feeders inserted inside hoppers for feeding the product, that the rigid containers are not filled in a uniform manner, that is, the variability in weight of the product inside the rigid containers does not fall within the tolerances requested by the final users of these machines (capsule manufacturers).

A strongly felt need by operators in this sector is that of having a unit and a method for filling containing elements (rigid, cup-shaped containers) of single-use capsules for extraction or infusion beverages which reduce the variability of the weight of the product introduced inside the containing elements and which are particularly simple, reliable and inexpensive and at the same time maintain a high overall productivity.

DISCLOSURE OF THE INVENTION

The aim of this invention is therefore to satisfy the above-mentioned need by providing a unit and a method for filling containing elements (rigid, cup-shaped containers) of single-use capsules for extraction or infusion beverages which reduce the variability of the weight of product introduced inside the containing elements.

Another aim is to provide a method and a machine for packaging single-use capsules for extraction or infusion beverages for filling the cup-shaped bodies which can be made relatively simply and inexpensively and which are particularly reliable.

Another aim of the invention is to provide a machine for packaging single-use capsules for extraction or infusion beverages which can guarantee a high productivity.

BRIEF DESCRIPTION OF DRAWINGS

The technical features of the invention, with reference to the above aims, are clearly described in the claims below and its advantages are apparent from the detailed description which follows, with reference to the accompanying drawings which illustrate a non-limiting example embodiment of the invention and in which:

DETAILED DESCRIPTION OF PREFERRED EMBODIMENTS OF THE INVENTION

With reference to the accompanying drawings, the numeral 1 denotes a unit for filling containing elements of single-use capsules 3 for extraction or infusion beverages, with a dose 33 of solid product in powder, granules or leaves, such as coffee, tea, milk, chocolate, or combinations of these.

The filling unit 1 is particularly suitable for filling containing elements of single-use capsules 3 with products in powder, preferably coffee.

Figure 2:
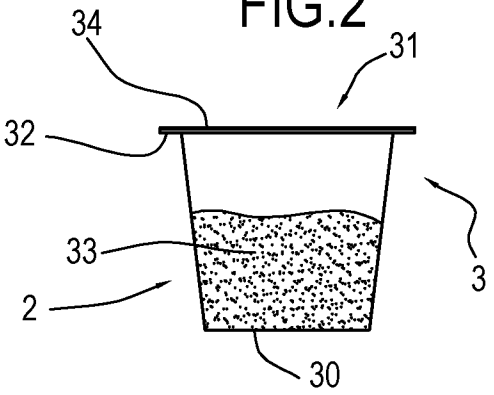
FIG. 2 is a schematic view of a single-use capsule for beverages which can be made by the machine of FIG. 1.

More specifically, as illustrated in FIG. 2, the single-use capsules 3 for extraction or infusion beverages comprise, in a minimum, but non-limiting, embodiment: a rigid, cup-shaped container 2 (usually to define a frustoconical shape) comprising a base 30 and an upper opening 31 equipped with a collar 32; a dose 33 of extraction or infusion product contained in the rigid container 2 and a lid 34 for closing the upper opening 31 of the rigid container 2.

It should also be noted that this type of capsule 3 may also comprise one or more filtering or product retaining elements (not illustrated here for simplicity reasons).

In the capsule 3 illustrated in FIG. 2, the rigid, cup-shaped container 2 defines the containing element to be filled with a dose 33 of product.

Other types of capsules may be filled with the filling unit according to the invention, for example capsules wherein the dose 33 of product is contained in, and retained by, a filtering element connected to the rigid container, wherein the rigid container can be closed at the bottom, or open.

In other words, in capsules not illustrated, a filtering element may contain and retain the dose 33 of product, forming the containing element in combination with the rigid container with which it is coupled.

In the following description, reference will be made to the rigid, cup-shaped container 2, but it is understood that the invention can be made with reference to capsules wherein the containing element is formed by a filtering element (or other components of the capsule designed to contain a dose 33 of product) and by the respective rigid container to which it is connected.

It should be noted that the filling unit 1 comprises a line 4 for transport (that is to say, movement) of rigid, cup-shaped containers 2 designed to contain a predetermined quantity of extraction or infusion product (dose 33) and a filling station SR.

The transport line 4 extends along a first movement path P and is provided with a plurality of seats 5 for supporting the rigid containers 2, arranged in succession along the first path P.

Preferably, the first movement path P is a closed path lying on a horizontal plane.

The supporting seats 5 are arranged one after another, not necessarily continuously. In addition, the supporting seats 5 each have a corresponding vertical axis of extension.

It should be noted that the transport line 4 comprises a transport element 39 to which the supporting seats 5 are connected to be moved along the first path P.

It should be noted that the transport element 39 is closed in a loop around movement means 17 which rotate about vertical axes for moving the transport element 39.

Preferably, the transport element 39 is a chain 40 comprising a plurality of links, hinged to one another in succession about corresponding vertical axes, to form an endless loop.

It should be noted that at least one of the links comprises at least one supporting seat 5 with a vertical axis for corresponding rigid container 2 which can be positioned with the opening 31 facing upwards.

It should be noted that the chain 40 may comprise both links having a corresponding supporting seat 5 and connecting links which are not provided with supporting seats 5 and which are interposed between links provided with supporting seats 5.

Therefore, preferably, a certain number of links comprises each supporting seat 5.

Preferably, but not necessarily, the movement means 17 rotate continuously about vertical axes to allow the transport element 39 to move continuously.

Described below is the station SR for filling the rigid, cup-shaped containers 2.

The station SR for filling the rigid, cup-shaped containers 2 comprises:

- at least a first containing seat S1 designed to receive a dose 33 of product;
- a substation ST1 for forming the dose 33 inside the first containing seat S1, provided with a device 6 for releasing a predetermined quantity of product forming the dose 33 inside the first containing seat S1;
- at least a second containing seat S2 designed to receive the dose 33 of product from the first containing seat S1;
- a substation ST2 for transferring the dose 33 of product from the first containing seat S1 to the second containing seat S2;
- devices 7 for moving the first containing seat S1 between the forming substation ST1 and the transfer substation ST2 and vice versa;
- a substation ST3 for releasing the dose 33 of product from the second containing seat S2 to a rigid, cup-shaped container 2 transported by the transport line 4;
- further devices 8 for moving the second containing seat S2 between the transfer substation ST2 and the release substation ST3 and vice versa.

More specifically, in one aspect, the release device 6 comprises at least one rotary element (40*a*; 40*b*), designed to rotate about a respective axis of rotation (X4; X5) to release the product inside the at least one first containing seat S1.

All the above-mentioned components forming part of the filling station SR of the rigid, cup-shaped containers 2 are described below in more detail, with particular reference to the accompanying drawings.

It should be noted that the devices 7 for moving the first containing seat S1 comprise a first device 9 rotating about a first axis X1 of rotation which is substantially vertical, on which is connected the first containing seat S1 to be rotated about the first vertical axis X1 of rotation.

Preferably, the first rotary device 9 comprises a wheel 9*a*, connected to respective means for driving the rotation.

More specifically, preferably, the filling station SR comprises a plurality of first seats S1.

The first seats S1 are connected radially to the first rotary device 9 (more precisely to the wheel 9*a*) to be rotated with it.

Preferably, the first seats S1 are made directly in the first rotary device 9, in particular they are made directly in the wheel 9*a*.

It should be noted that the first seats S1 are positioned along an arc of a circle, preferably along a circumference having as the centre a point of the first axis X1.

Still more preferably, the first seats S1 are angularly equispaced from each other along a circumference having as the centre a point of the first axis X1.

It should be noted that each first seat S1 follows a second path P1, preferably circular having as the axis of rotation the first axis X1 in such a way as to engage cyclically—during rotation—the substations for forming (ST1) and transferring (ST2) the dose.

Alternatively, the first seats S1 are connected to the first rotary device 9 by means of a rod (not illustrated), which is movable radially relative to the first rotary device 9.

Each first seat S1 is defined, preferably, by lateral walls of a cavity 18 and by a bottom wall F. Preferably, the cavity 18 is a cylindrical cavity.

Furthermore, still more preferably, the cavity 18 has a vertical axis of extension (parallel to the first axis X1 of rotation).

Again, preferably, the filling station SR comprises, for each first seat S1:

- a piston 13, which is movable between a lower position where it defines the bottom wall F of the first seat S1 and an upper position in which fully occupies the space of the first seat S1, or in other words, closes the top of the cavity 18;
- means 14 for moving the piston 13, configured for moving the piston 13 between the above-mentioned lower and upper positions.

Examples of movement means 14 are electric motors, pneumatic devices, cam devices, and other prior art devices.

It should be noted that the expression "the piston 13 fully occupies the space" means that the piston 13 is positioned in the seat so as not to allow the presence of the dose 33 inside the first seat S1.

Preferably, the filling station SR comprises movement means 14 which are independent for each piston 13, so that each piston can be moved independently of the others.

Preferably, the cavities 18 are through cavities and the pistons 13 are movable in a linear fashion inside the cavities 18, for varying the space of the first seats S1 (lower position) and for expelling the doses 33 from the first seats S1 (upper position).

The forming ST1 and transfer ST2 substations are positioned along the periphery of the first rotary device 9 in such a way as to be engaged cyclically by the first seats S1 during rotation around the first axis X1.

More specifically, the forming ST1 and transfer ST2 substations are arranged in a predetermined position relative to a frame 29 of the filling station SR, along the second movement path P1 of the first seat S1.

In this regard, it should be noted that in a complete rotation of the first rotary device 9 each of the first seats S1 is positioned in the forming substation ST1 and in the transfer substation ST2.

Preferably, the second movement path P1 is closed. Preferably, the second movement path P1 is a circular path around the first axis X1.

Still more preferably, the second path P1 lies on a horizontal plane.

Described below is the substation ST1 for forming the dose 33.

The substation ST1 for forming the dose 33 is positioned in a region R1 for forming the dose 33.

With reference to the substation ST1 for forming the dose 33, it should be noted, as already mentioned, that at that substation there is the release device 6, designed for releasing a predetermined quantity of product (defining the dose 33) inside the containing seat S1 positioned in the region R1 for forming the dose 33.

The releasing device 6 preferably comprises a hopper 38 (filled, in use, with product) having at the bottom an outfeed 19 for the product.

It should be noted that the above-mentioned at least one rotary element (40*a*; 40*b*) is associated with the hopper 38, for moving the product contained therein.

The rotary element (40*a*; 40*b*) has a helical profile which extends between a first end E1 and a second end E2.

The rotary element (40*a*; 40*b*) is configured to rotate according to a speed of rotation about a respective axis (X4; X5) of rotation, in such a way that the first end E1 adopts an angular position variable over time around the respective axis (X4; X5) of rotation, to create an axial flow of feeding a product, from the second end E2 towards the first end E1, which intercepts the at least one first containing seat S1 so as to release the product inside the at least one first containing seat S1.

This respective axis of rotation (X4; X5) is fixed relative to the hopper 38. It should be noted that the axis of rotation (X4; X5) of the rotary element 40*a* is inclined relative to a horizontal plane.

According to this aspect, the product is fed by the rotary element (40*a*; 40*b*) angularly, according to the direction of extension of the relative axis of rotation (X4; X5), so that the motion of the product has, as well as a horizontal component, also a vertical component which favours the insertion of the product inside the first seat S1 in transit in the region R1 for forming the dose (slightly compressing the product inside the first seat S1).

Advantageously, therefore, the fact that the axis (X4; X5) of the rotary element (40*a*; 40*b*) is angularly positioned relative to a horizontal plane makes it possible to optimize the filling of the first seat S1.

The rotary element (40*a*; 40*b*) is rotated in such a way that the product is pushed, along the direction of extension of the relative axis of rotation X4, in the direction from the second end E2 towards the first end E1.

It should be noted that the rotary element (40*a*; 40*b*) defines a unit for feeding the product inside the first seat S1.

It should also be noted that the release device 6 also comprises drive means (such as, for example, a drive unit), operatively coupled to the rotary element (40*a*; 40*b*) for rotating the rotary element (40*a*; 40*b*).

The outfeed 19 of the hopper 38 (located beneath the first end E1 of the rotary element 40*a*) is configured to create a layer of product at the region R1 for forming the dose 33 above the first seats S1, so as to release the product inside the first seat(s) S1 positioned, each time, in the forming region R1.

More specifically, the outfeed 19 of the hopper 38 is shaped in such a way as to occupy a portion of the second movement path P1 of the first seats S1.

More specifically, the outfeed 19 is in the form of a arc, centred on the first axis X1.

It should also be noted that the outfeed 19 of the hopper 38, in the preferred embodiment, releases the product at a plurality of first seats S1 positioned temporarily in the region R1, that is to say, opposite below the outfeed 19.

It should be noted that according to another aspect the hopper 38 is equipped with a lower portion 19 for releasing the product (defined by the outlet 19 and shown in the drawings with the same reference numeral) to the first seat S1 and the first end E1 of the helical profile of the above-mentioned at least one rotary element (40*a*; 40*b*) is positioned facing above, and in the proximity of, the above-mentioned lower portion 19 for releasing the product of the hopper 38.

In this way, advantageously, the rotary element (40*a*; 40*b*) with a helical profile is positioned proximal to the first seat S1 to be filled so as to apply a compressive action on the product released inside the first seat.

Preferably, the first seat S1 has a circular shape, in plan, having a predetermined diameter and the hopper 38 has a lower portion 19 for releasing the product (defined by the outfeed 19) to the first seat S1 having a width, in plan, substantially equal to the predetermined diameter of the first seat S1.

This aspect, advantageously, optimises the release of the product to the first seat S1, that is, the identical dimensions, in plan, of the first seat S1 and the lower portion 19 for releasing the product are such that any accumulation of product at the bottom of the hopper 38 is substantially avoided.

According to the invention, the unit 1 is also provided with a drive and control unit 15, operatively connected to the at least one rotary element (40*a*, 40*b*) and configured to rotate it at a speed of rotation variable as a function of the angular position of the first end E1 of the rotary element (40*a*; 40*b*) (around the respective axis of rotation (X4, X5)).

It should be noted that the drive and control unit 15 comprises one or more electronic control cards.

In other words, the drive and control unit 15 is configured for actuating and modifying the speed of rotation of the rotary element (40*a*; 40*b*) as a function of the angular position of the first end E1 of the rotary element (40*a*; 40*b*).

Thus, the drive and control unit 15 rotates the rotary element (40*a*; 40*b*) according to a (variable) speed profile (that is, law) which depends on the angular position of the first end E1 of the rotary element (40*a*; 40*b*).

Surprisingly, it has been observed that the actuation of the rotary element at variable speed as a function of the angular position of the first end E1 of the rotary element (40*a*; 40*b*) makes it possible to reduce the variability in the weight of the product introduced in the first seats S1 (which translates into a reduction in the variability in the weight of the product introduced in the rigid, cup-shaped containers), that is, it makes the quantity of product introduced in the first seats S1 uniform.

According to the invention, the pushing effect of the first end E1 of the rotary unit 40*a* variable as a function of the angular position of the first end E1 of the rotary unit (40*a*; 40*b*) is compensated through a command of the rotary element (40*a*; 40*b*) according to a speed profile variable as a function of the angular position of the first end E1 of the rotary element 40*a*, so that the thrust is as uniform as possible over time and independent of the angular position of the first end E1 of the rotary unit (40*a*; 40*b*). In practice, therefore, according to the invention, the fact of rotating the rotary element (40*a*; 40*b*) at a variable speed which depends on the angular position of the first end E1 (the one proximal to the first seat S1) makes it possible render uniform the thrust of the product towards the first seats S1 and, therefore, the filling between the different seats S1.

It should also be noted that, according to the invention, in a complete rotation of the rotary element (40*a*; 40*b*) a plurality of first seats S1 are filled with product; thus, the first seats S1 filled in a complete rotation of the rotary element are subject to filling with the first end E1 positioned in different positions.

Is therefore evident that the invention allows the filling of the various seats S1 to be made uniform, since the effect of pushing the first end E1 of the helical profile of the rotary element (40*a*; 40*b*) in different angular positions is made uniform.

Certain aspects relating to the speed control of the rotary element (40*a*; 40*b*) are described below.

Figure 13:
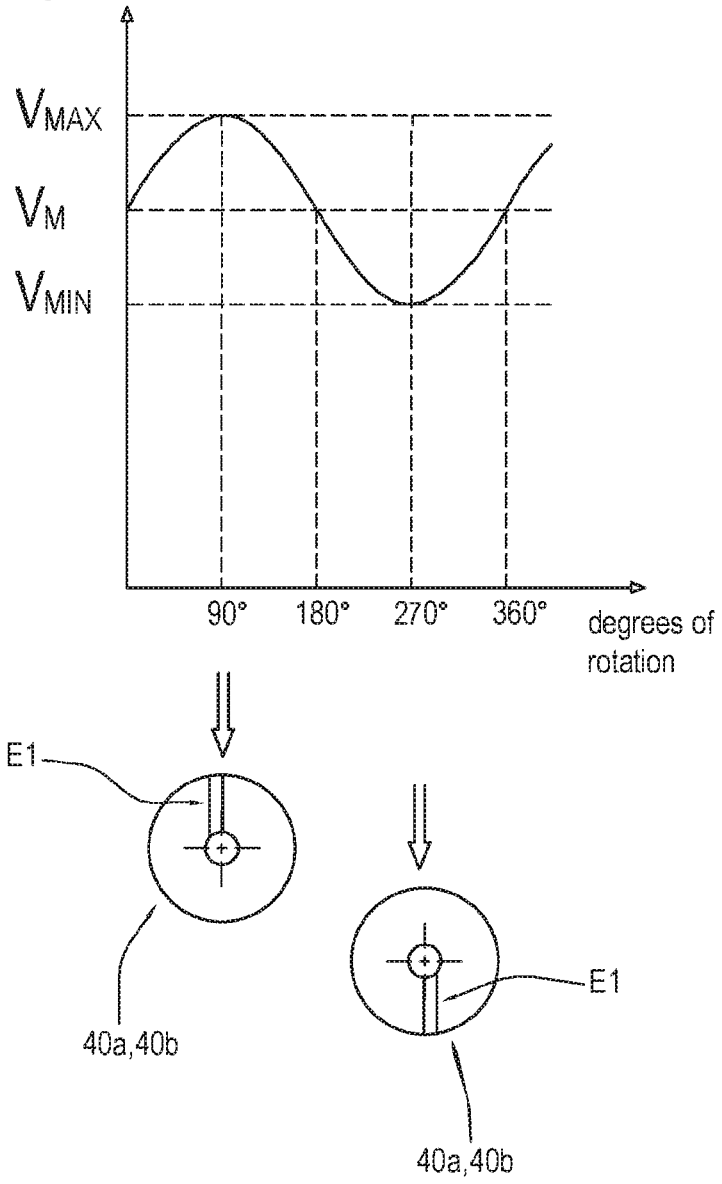
FIG. 13 schematically illustrates a preferred speed of rotation law of a rotary element forming part of the filling unit according to the previous figures.

Preferably, as illustrated in FIG. 13, the drive and control unit 15 is configured to rotate the at least one rotary element (40*a*; 40*b*) according to a sinusoidal law of speed (L1, L2), having a predetermined average value VM or average speed, as a function of the angular position of the first end E1 of the rotary element (40*a*; 40*b*).

FIG. 13 is a representation of the speed profile of the first end E1 of the rotary element (40*a*; 40*b*) as a function of the angular position (in sexagesimal degrees) of the first end E1 (shown beneath the graph of FIG. 13 for two angular positions, of 90° and 270° respectively).

More specifically, again with reference to this aspect illustrated in FIG. 13, the drive and control unit 15 is configured to rotate the at least one rotary element (40*a*; 40*b*) according to a sinusoidal law of speed (L1, L2), having a predetermined amplitude (difference between VMAX and VM). Still more preferably, the drive and control unit 15 is configured to rotate the at least one rotary element (40*a*; 40*b*) according to a sinusoidal law of speed (L1, L2), having a predetermined amplitude (difference between VMAX and VM) and a predetermined average value VM.

It should be noted that, preferably, the drive and control unit 15 is configured to rotate the at least one rotary element (40*a*; 40*b*) in such a way that the sinusoidal function has a maximum value (VMAX) when the first end E1 is positioned at the top (90° position in FIG. 13) and a minimum value (Vmin) when the first end E1 is located at the bottom (270° position in FIG. 13).

Alternatively, the drive and control unit 15 is configured to rotate the at least one rotary element (40*a*; 40*b*) according to a sawtooth law of speed (L1, L2), having a predetermined average value VM, as a function of the angular position of the first end E1 of the rotary element (40*a*; 40*b*).

More generally, the drive and control unit 15 is configured to rotate the at least one rotary element (40*a*; 40*b*) as a function of the angular position of the first end E1 of the rotary unit (40*a*; 40*b*) according to a law of speed (L1, L2) having a predetermined average value VM and comprising in a complete rotation a minimum speed value (Vmin) and a maximum speed value (VMAX).

In the embodiment illustrated, the maximum speed value (VMAX) corresponds to an upper position of the first end E1 of the rotary element (40*a*; 40*b*), whilst the minimum speed value (Vmin) corresponds to a lower position of the first end E1 of the rotary element (40*a*; 40*b*).

In alternative embodiments not illustrated, the drive and control unit 15 is configured to rotate the at least one rotary element (40*a*; 40*b*) as a function of the angular position of the first end E1 of the rotary unit (40*a*; 40*b*) according to a law of speed (L1, L2) having more than one minimum speed value and/or more than one maximum speed value.

In general, the drive and control unit 15 is configured to rotate the at least one rotary element (40*a*; 40*b*) as a function of the angular position of the first end E1 of the rotary unit (40*a*; 40*b*) according to a law of speed (L1, L2) having periodic features.

Figure 3:
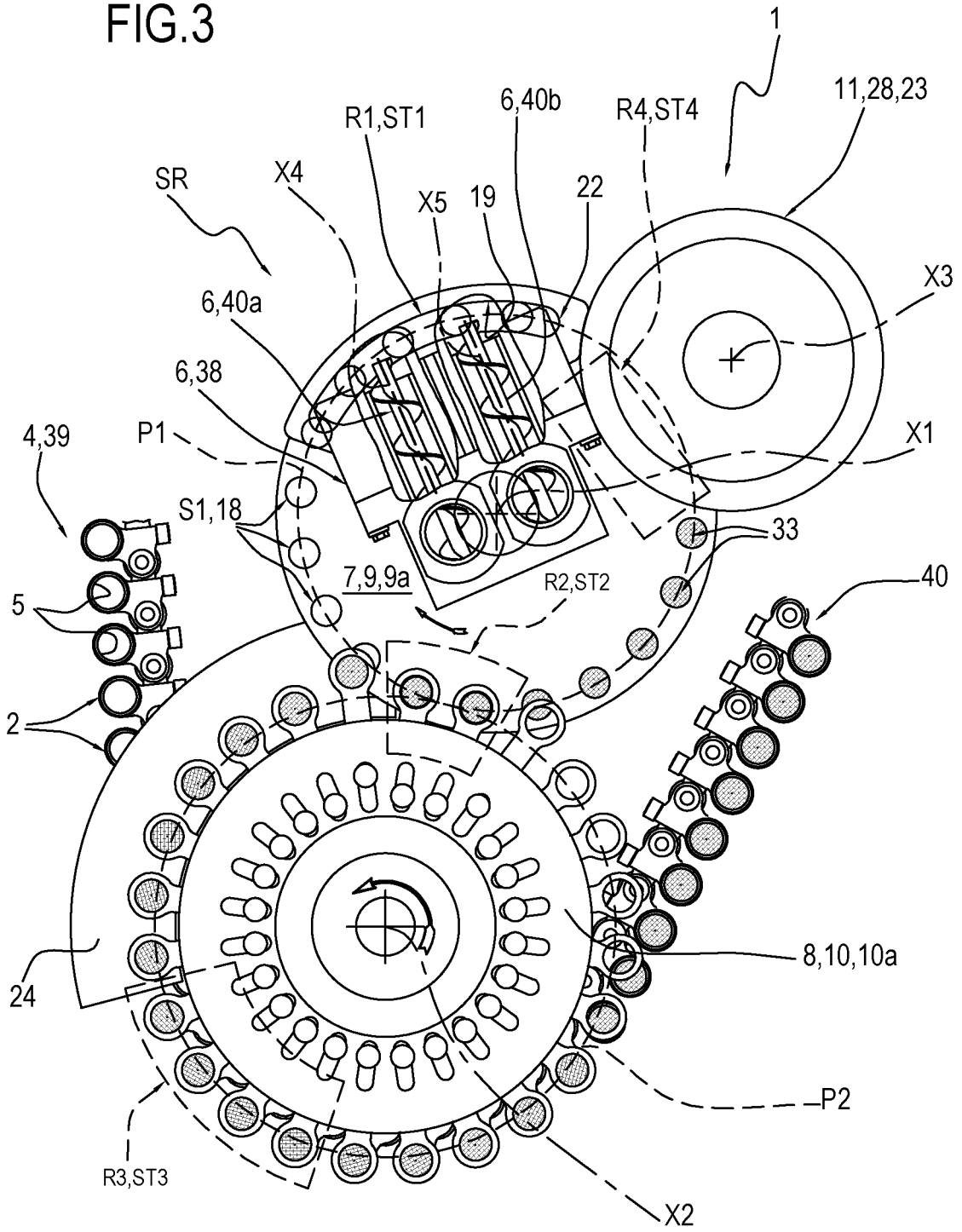
FIG. 3 is a plan view of the capsule filling unit according to a first embodiment.
Figure 4:
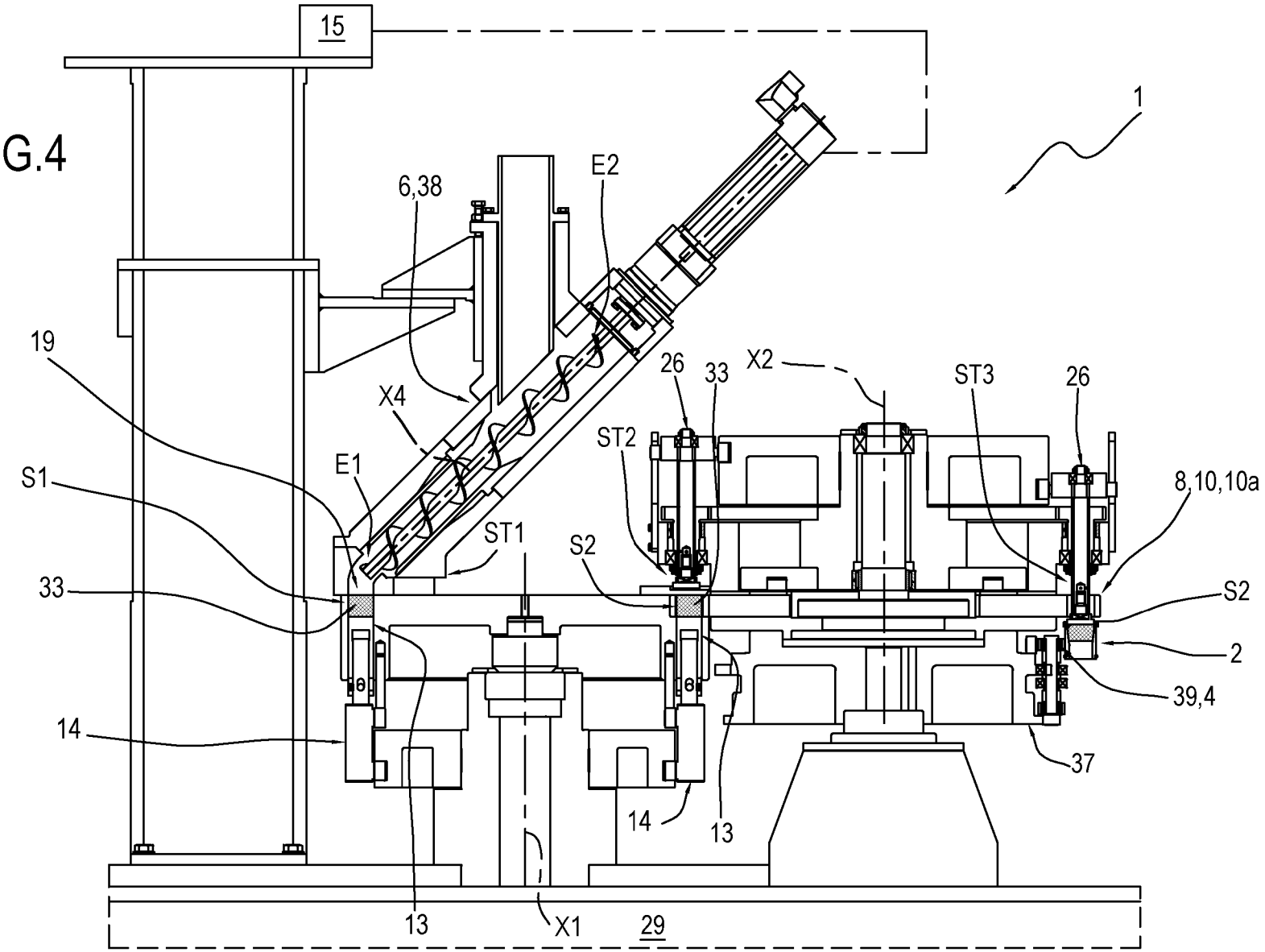
FIG. 4 is a cross section view of a filling station of a filling unit of FIG. 3, with some parts cut away to better illustrate others.
Figure 5:
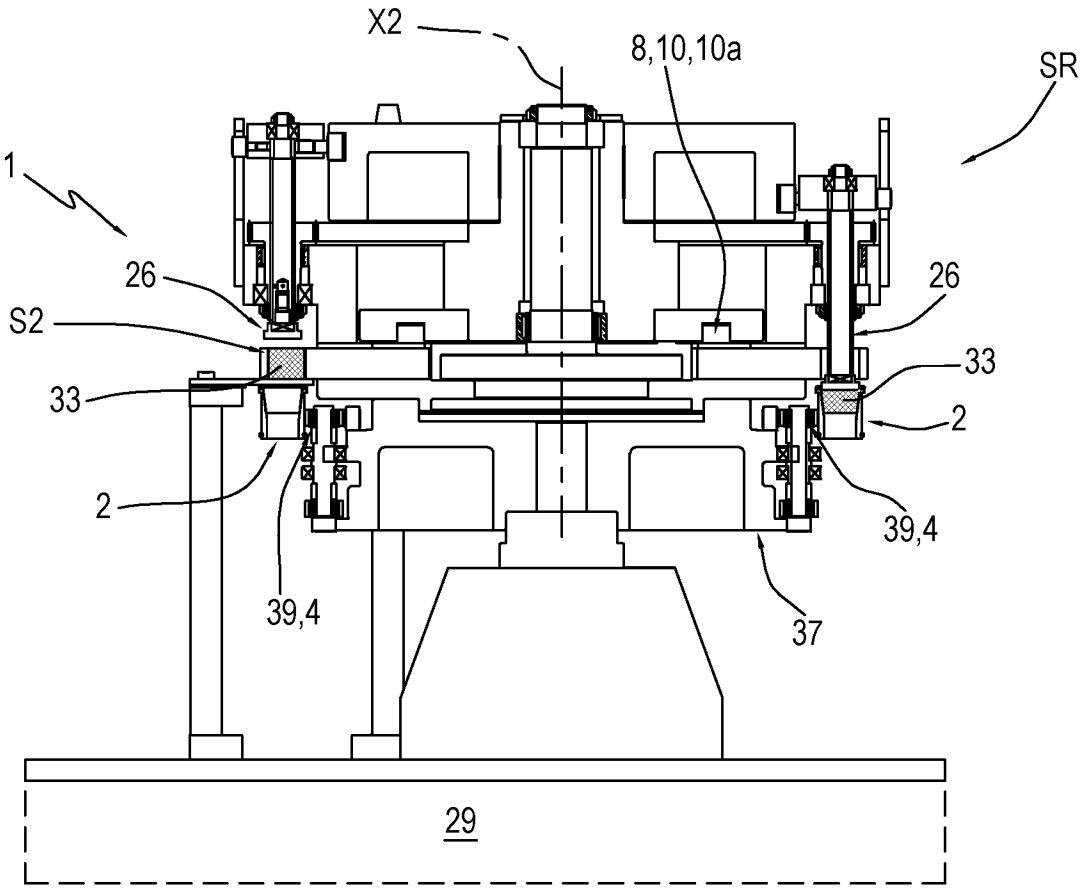
FIGS. 5 and 6 are respective cross sections of components of the filling station of FIG. 4, with some parts cut away to better illustrate others.
Figure 6:
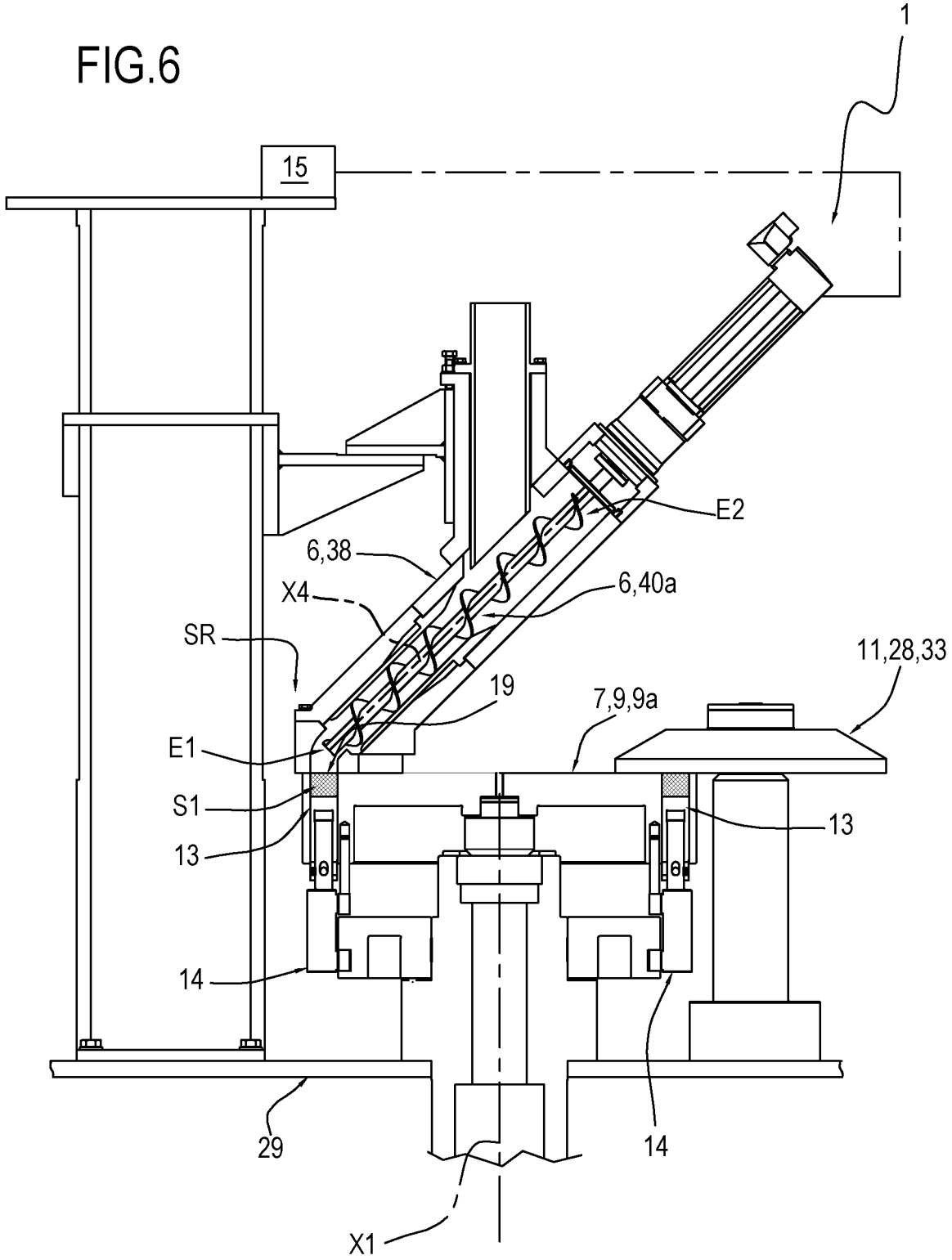

With reference to the accompanying FIGS. 3, 4 and 6, the release device 6 comprises a pair of rotary elements (40*a*; 40*b*), that is to say:

- a first rotary element 40*a* having a helical profile which extends between a first end E1 and a second end E2, configured to rotate about a respective first axis X4 of rotation fixed relative to the hopper 38 and positioned angularly inclined to a horizontal plane, for creating a feed flow of product axially, from the second end E2 towards the first end E1, which intercepts (at the forming region R1) the at least one first containing seat S1 so as to release the product inside the at least one first containing seat S1,
- and a second rotary element 40*b* having a helical profile which extends between a first end E1 and a second end E2 and configured to rotate about a respective second axis X5 of rotation fixed relative to the hopper 38 and positioned angularly inclined to a horizontal plane, for creating a feed flow of product axially, from the second end E2 towards the first end E1, which intercepts the at least one first containing seat S1 so as to release the product inside the at least one first containing seat S1.

It should be noted that, preferably, the second rotary element 40*b* is positioned parallel to the first rotary element 40*a* (that is, the axes X4 and X5 are parallel with each other).

further axis of rotation X5 of the second rotary element 40*b* is stationary relative to the hopper 38, or, equally, to the frame 29.

The axis X5 is also angularly inclined to a horizontal plane.

It should also be noted that the second rotary element 40*b* described above defines a screw feeder, which by rotation about the further axis of rotation X5 allows a feeding of the product along the direction of axial extension defined by the further axis of rotation X5 (so as to fill the seats S1 in transit in the forming region R1).

According to the embodiment illustrated in the drawings, the drive and control unit 15 is operatively connected to the first rotary element 40*a* and second rotary element 40*b* and is configured for rotating the first rotary element 40*a* and the second rotary element 40*b* according to first and second rotation speeds, respectively, variable as a function of the angular position of the first ends E1 of the respective helical profile.

The drive and control unit (15) is configured to rotate the first rotary element 40*a* and the second rotary element 40*b* according to respective laws of speed (L1; L2).

Figure 14:
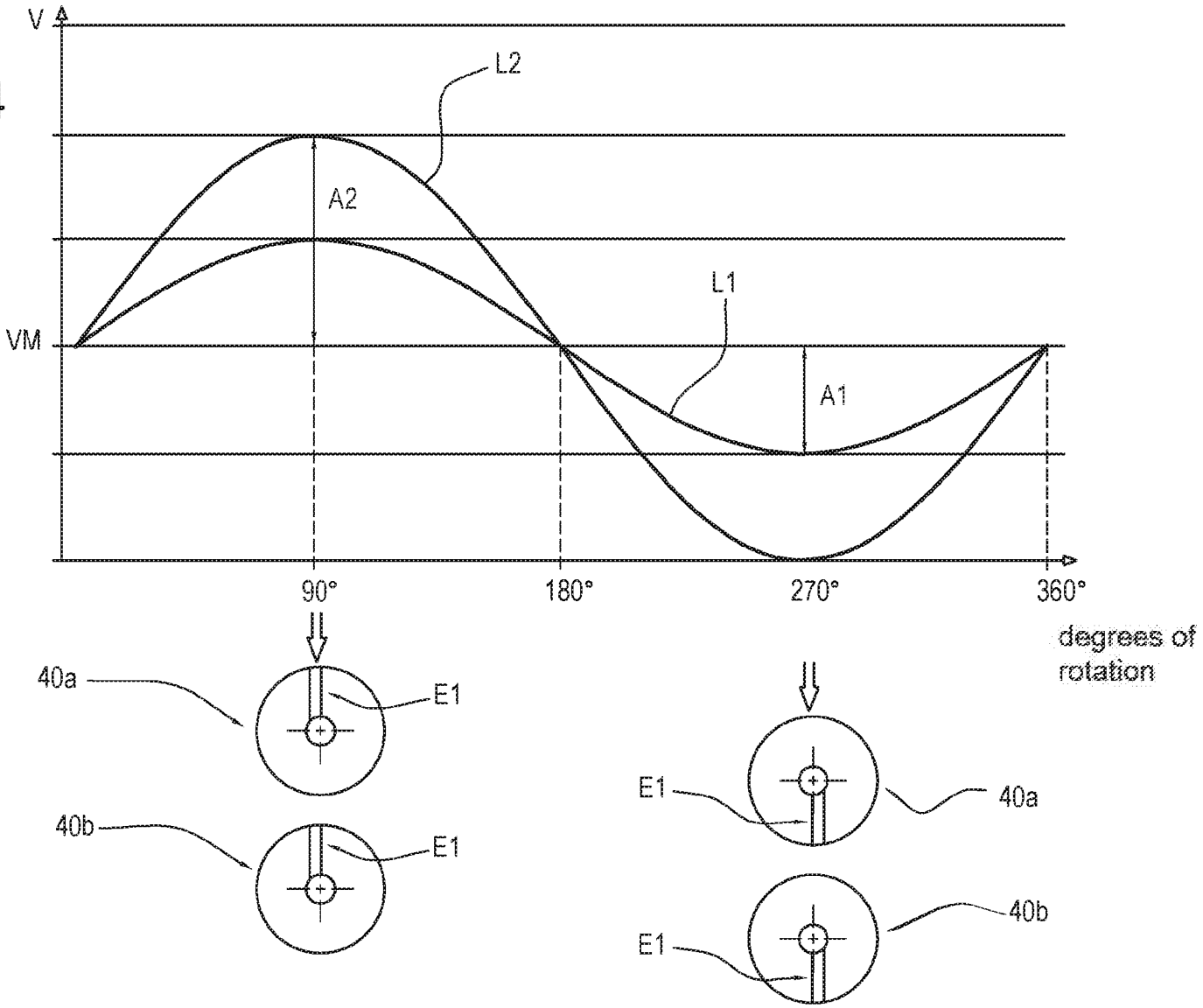
FIG. 14 schematically illustrates a first speed of rotation law of two rotary elements forming part of the filling unit according to FIGS. 3, 5 and 6.
Figure 15:
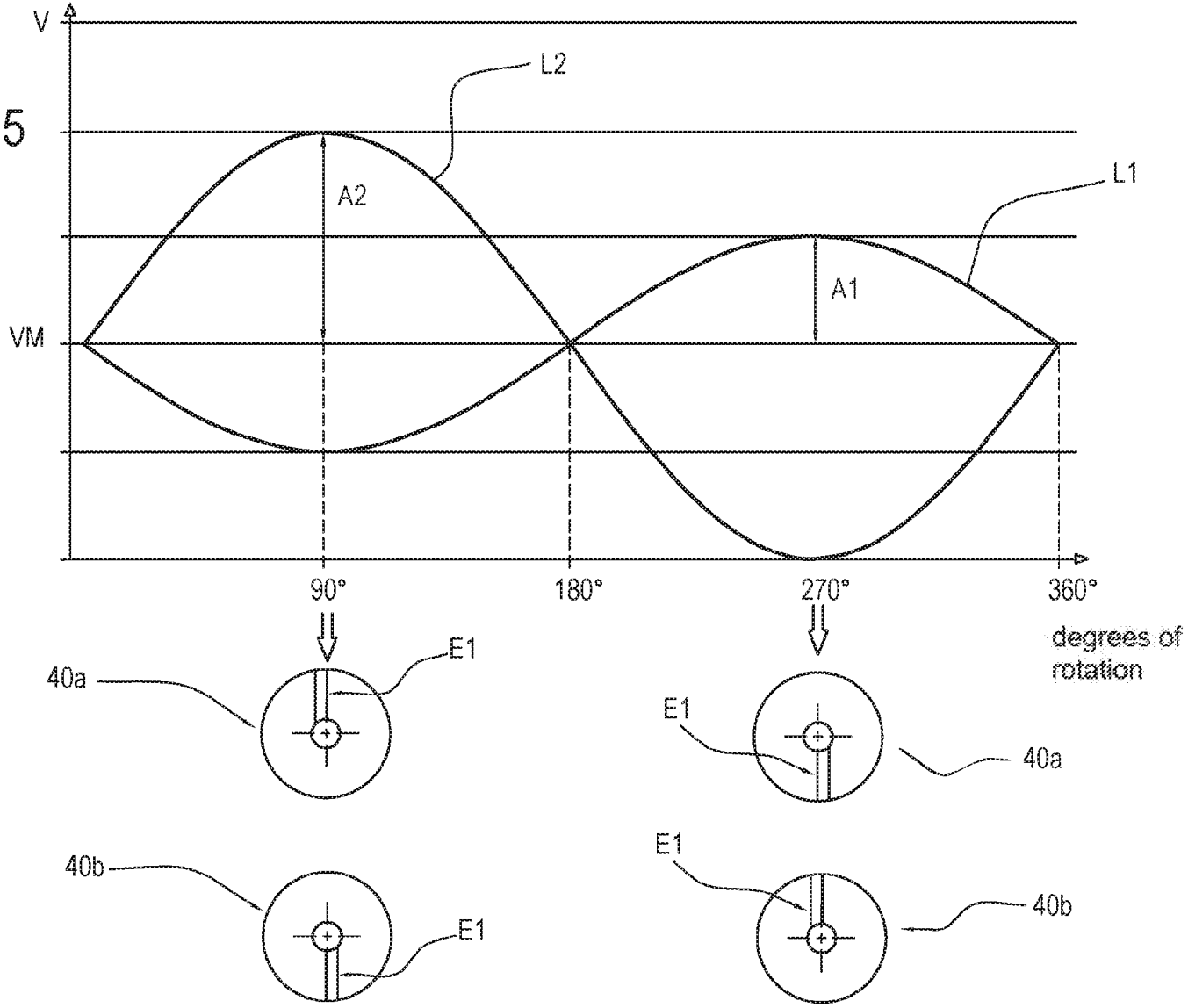
FIG. 15 schematically illustrates a second speed of rotation law of two rotary elements forming part of the filling unit according to FIGS. 3, 5 and 6.

Preferably, the drive and control unit 15 is configured for actuating the first rotary element 40*a* and the second rotary element 40*b* according to sinusoidally variable speeds (as illustrated in FIGS. 14 and 15).

The drive and control unit 15 is configured for actuating at the same frequency of rotation (that is, at the same average speed VM) the first rotary element 40*a* and the second rotary element 40*b*. In other words, the first rotary element 40*a* performs a complete rotation of 360° in the same time in which the second rotary element 40*b* performs a complete rotation of 360°.

Still more preferably, the drive and control unit 15 is configured to rotate the first rotary element 40*a* and the second rotary element 40*b* according to a predetermined angular phase relationship, for example as illustrated in FIGS. 14 and 15.

With reference in particular to FIG. 15, it should be noted that, preferably, the drive and control unit 15 is configured to rotate the first rotary element 40*a* and the second rotary element 40*b* in opposite phases (in such a way that a given instant a maximum value of the speed of rotation of the first rotary element 40*a* corresponds to a minimum value of the speed of rotation of the second rotary element 40*b*).

In general, the drive and control unit 15 is configured to rotate the first rotary element 40*a* and the second rotary element 40*b* in phase, in such a way that, after defining a time interval (period), the first ends E1 of the respective rotary elements 40*a*, 40*b* adopt a same mutual angular position.

In alternative embodiments not illustrated, the drive and control unit 15 is configured to rotate the first rotary element 40*a* and the second rotary element 40*b* in phase, in such a way that a complete rotation of the first rotary element 40*a* corresponds to one or more complete, or partial, rotations of the second rotary element 40*b*, or that a complete rotation of the second rotary element 40*b* corresponds to one or more complete, or partial, rotations of the first rotary element 40*a*. In other words, a complete rotation of the first rotary element 40*a* may correspond to a multiple number, not necessarily whole, of rotations of the second rotary element 40*b*.

It should be noted that the degrees of rotation indicated on the X-axis of FIGS. 14 and 15 correspond to the angular position of the first end E1 of the first rotary element 40*a* which varies over time t.

According to what has been described above and with reference to the embodiment illustrated in the accompanying drawings, preferably the hopper 38 is equipped with a lower portion 19 for releasing the product to the first seat S1 and the first ends E1 of the helical profile of the first and second rotary element (40*a*; 40*b*) are positioned facing above, and in the proximity of, the above-mentioned lower portion of the hopper 38 for releasing the product.

According to the aspect described above, the first rotary element 40*a* and the second rotary element 40*b* are positioned relative to each other in such a way that the first rotary element 40*a* firstly intercepts the first seat S1 when arriving in the forming region R1.

Further, advantageously, according to this aspect, the drive and control unit 15 is configured to rotate the second rotary element 40*b* with a second amplitude A2 which is different, advantageously greater, from a first amplitude (A1) of the first rotary element 40*a* (as illustrated in FIGS. 14 and 15).

The technical effect associated with the above-mentioned features is explained below.

It should be noted that the first seat S1, at the second rotary element 40*b*, is already partly filled (by the effect of the product inserted from the hopper and by the first rotary element).

According to this aspect, with the same average speed of rotation (that is, of rotation frequency), due to the greater amplitude (A1) of the rotation speed of the second rotary element 40*b*, the second rotary element 40*b* applies a thrust on the product to be introduced in the first seat S1 which is greater than that of the first rotary element 40*a*.

In this way, after the first rotary element 40*a* has loaded product in the first seat S1, the second rotary element 40*b* compresses the product inside the first seat S1; a compression necessary for loading a predetermined quantity of product inside the first seat S1.

As illustrated in FIGS. 14 and 15, the drive and control unit 15 is also configured to rotate the second rotary element 40*b* with a average speed VM equal to the average speed VM of the first rotary element 40*a*.

According to another aspect, on the contrary to what is illustrated in FIGS. 14 and 15, the drive and control unit 15 is configured to rotate the second rotary element 40*b* with an average speed (rotation frequency) equal to the average speed of the first rotary element 40*a*.

With reference to another aspect of the unit 1, it should be noted that the piston 13 occupies the lower position in at least one stretch of the region R1 for forming the dose 33.

In other words, the first seats S1, passing below the hopper 38, are filled with product, in a filling time which depends on the speed of transit of the first seats S1 in the forming region R1 and on the amplitude of the portion of the second movement path P1 of the first seats S1 occupied by the outfeed 19 of the hopper 38. With reference to the movement of the piston 13 in the region R1 for forming the dose, the following should be noted.

Preferably, the piston 13 associated with the first seat S1 is positioned in the upper position where it prevents the filling of the first seat S1 (in this upper position the piston 13 closes the top of the seat 18 which defines the first seat S1) until the first seat S1 has completely entered inside the region R1 for forming the dose, at an infeed zone of the region R1 for forming the dose.

Also, preferably, when the above-mentioned first seat S1 is inside the region R1 for forming the dose, in particular at the infeed zone, the piston 13 associated with the first seat S1 is moved from the upper position to a lower end position.

The first seat S1 is therefore filled not only by gravity acting on the product which causes the product to enter the seat S1 but also due to the suction effect on the product caused by the movement (displacement) of the piston 13 from the upper position to the lower end position.

In this way, advantageously, thanks to the additional suction effect, the resulting speed of the machine 100 at the filling station SC, in particular at the substation ST1 for forming the dose, is particularly high.

It should be noted that in this lower end position, the first seat S1 defines a first space.

Preferably, during the movement of the first seat S1 inside the forming region R1, in particular at a zone positioned between the infeed zone in the region R1 for forming the dose and an outfeed zone of the region R1 for forming the dose, the piston 13 associated with the seat S1 may advantageously be moved from the lower end position to a dosing position between the lower end position and the upper position.

It should be noted that the piston 13, in the above-mentioned dosing position, forms with the side walls of the first seat S1 a predetermined space for containing a desired quantity of product (this space is less than the first space which is defined at the lower end position).

The fact of having firstly the piston in the lower end position, in which it defines a first containment space, and then the piston 13 in the dosing position means that the powder deposited inside the first seat S1 undergoes a first compression in the region R1 for forming the dose. The first compression contributes to rendering uniform the placing the powder inside the seat and increasing the apparent density of the powder.

According to one embodiment illustrated in the accompanying drawings, the release device 6 comprises at least a first rotary element 40*a*, designed to rotate about its axis of rotation X4. The axis of rotation X4 of the first rotary element 40*a* is stationary relative to the hopper 38, or equally, to the frame 29. The first rotary element 40*a* is configured to create a flow of product which intercepts the at least one first seat S1 and to release the product inside the at least one first containing seat S1 in transit through the region R1 for forming the dose.

Advantageously, the flow of product intercepts the at least one first seat S1 at the infeed zone of the region R1 for forming the dose.

It should be noted that, preferably, the first rotary element 40*a* is operating in the region R1 for forming the dose on a plurality of seats S1 simultaneously (on the seats S1 temporarily in transit through the forming region R1).

It should be noted that the first rotary element 40*a* is operating in the region R1 for forming the dose 33, to release the product inside the first containing seat S1 in transit through the region R1.

It should be noted that the release device 6 also comprises drive means (such as, for example, a first drive unit 43*a*), operatively coupled to the first rotary element 40*a* to rotate the rotary element 40*a*.

The first rotary element 40*a* preferably comprises an element 41*a* which defines a surface with a helical extension.

The helical surface extends—in a spiral shape—along the axis of rotation X4 of the first rotary element 40*a*.

The first rotary element 40*a* also comprises a respective first shaft 42*a*, to which the element 41*a* is connected, defining a surface with a helical extension for being rotated.

The first shaft 42*a* is supported rotatably relative to the frame of the filling unit 1.

The first shaft 42*a* extends along the axis of rotation X4 of the first rotary element 40*a*.

It should also be noted that the first rotary element 40*a* described above defines a screw feeder, which by rotation about the axis of rotation X4 allows a feeding of the product along the direction defined by the axis of rotation X4.

With reference to the axis of rotation X4 of the first rotary element 40*a*, the following should be noted.

Figure 11:
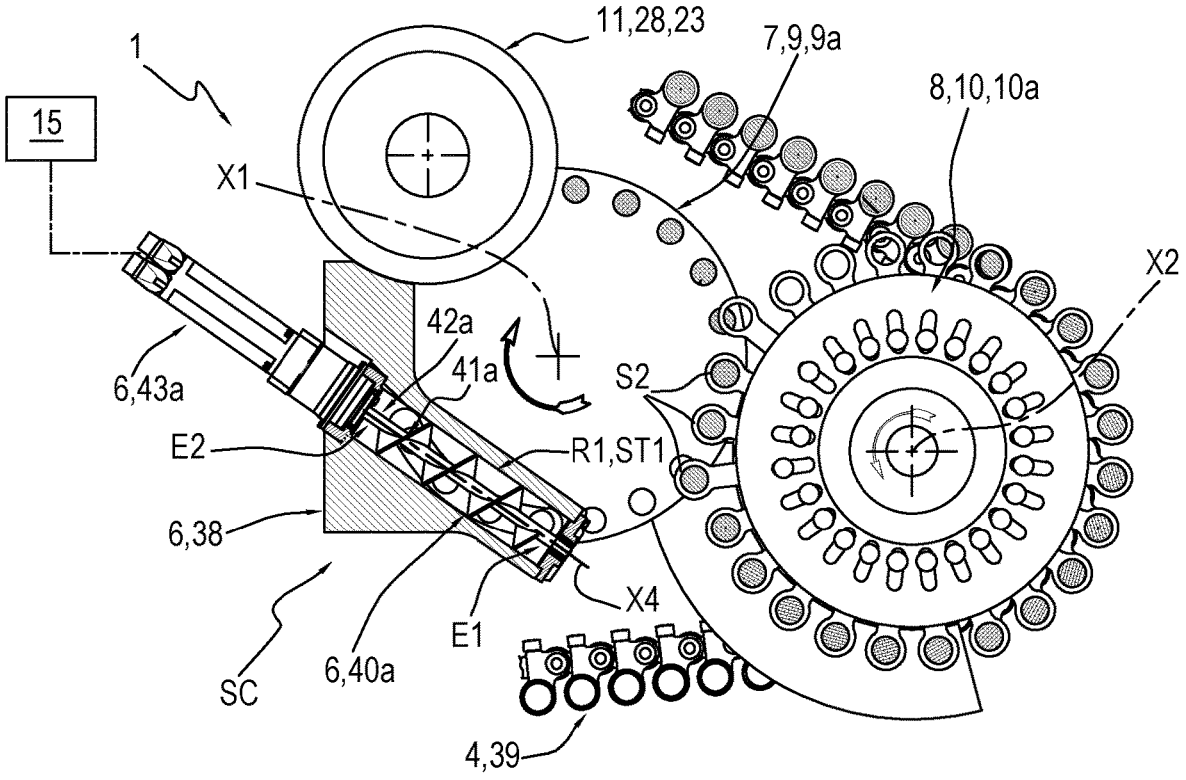
FIGS. 11 and 12 are plan views from above and partial cross sections, respectively, of the filling unit according to the invention in a further embodiment.
Figure 12:
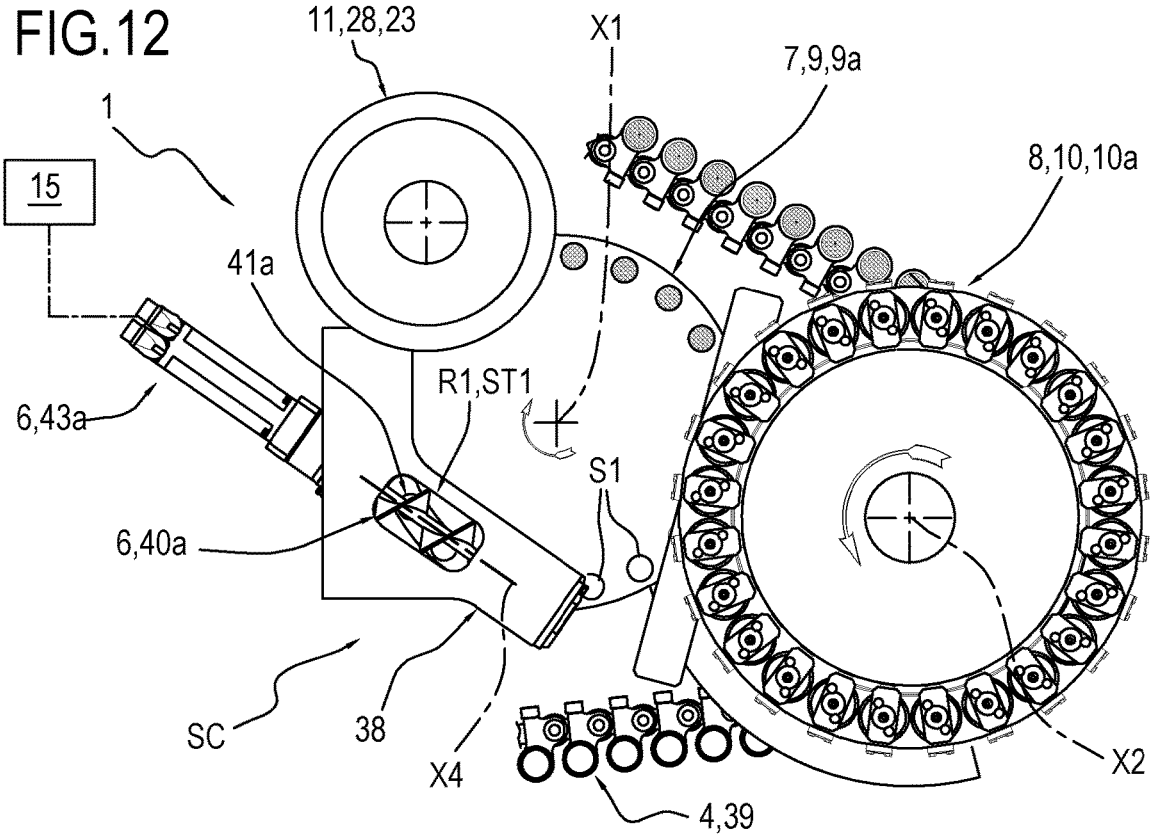

According to a further embodiment, illustrated in the FIGS. 11 and 12, the axis of rotation X4 of the first rotary element 40*a* is horizontal.

It should be noted that according to a second embodiment, not illustrated in the accompanying drawings, the axis of rotation X4 of the first rotary element 40*a* is vertical.

According to yet another aspect, it should be noted that the control unit 15 of the machine 100 is configured to rotate the at least one rotary element (first and/or second) of the release device 6 with a law of speed (L1, L2) the amplitude and/or frequency and/or average speed of which may vary as a function of the speed of movement of the first seat S1 by the first device 9 rotating about the first axis X1 of rotation and the amount of product to be fed.

It should be noted that, in any case, the speed of rotation of the rotary element (first and/or second) also always depends, according to the invention, on the angular position of the first end (40*a*; 40*b*) of the helical profile.

Advantageously, in the embodiment with a first rotary element 40*a* and a second rotary element 40*b*, the drive and control unit 15 of the machine 100 rotates these rotary units (40*a*, 40*b*) and moves the first seat S1 at a speed such that, if a first seat S1 passes the first rotary element 40*a* driven at a maximum speed of rotation, the first seat S1 passes the second rotary element 40*b* driven at a minimum speed of rotation.

Further, according to another aspect of the invention, the control unit 15 of the machine 100 is designed to rotate the at least one first rotary element 40*a* of the release device 6 according to a variable law of speed (L1, L2) the frequency and/or amplitude of which is a function of the quantity of product to be inserted inside each first seat S1.

More in detail, it is possible to increase the quantity of product inserted inside each seat by increasing the average speed of rotation of the rotary element (40*a*; 40*b*), in such a way as to increase the apparent density of the product, and vice versa. In other words, it is possible to vary the quantity of product contained in the first seat S1, and hence in the capsules 3, by adjusting the average speed of rotation of the at least one rotary element (40*a*; 40*b*).

It should be noted that, advantageously, the presence of one or more rotary elements (40*a*, 40*b*) allows the filling to be optimised and prevent, in particular with powder type products (such as, for example, coffee), the creation of blockages, that is, build-ups, inside the hopper which render incomplete the filling of the first seats S1 in transit through the region R1 for forming the dose.

Indeed, it should be noted that the one or more rotary elements (40*a*, 40*b*) are rotated simultaneously so as to move the product and prevent the formation of any blockage inside the hopper 38 for feeding the product.

In this way, advantageously, the speed at which the unit 1 may be used is particularly high and, consequently, the unit 1 is particularly fast and reliable in its operation.

Moreover, with two rotary elements (40*a*, 40*b*) it is possible to further even out the quantity of product inside the rigid containers 2, in other words reduce the variability in weight of the doses 33 fed.

According to another aspect, it should be noted that the release device 6 is also equipped with a levelling device 22, located in such a way as to prevent the product being dispersed out of the region R1 for forming the dose 33, except for the product contained in the first seats S1, that is, the individual doses 33.

Basically, the levelling element 22 and the piston 13 define the dose 33 contained in the first seats S1.

According to the invention, by varying the position of the piston 13 by means of the movement means 14 in the region R1 for forming the dose 33 it is possible to vary the quantity of product contained in the first seats S1, or in other words, it is possible to vary the dose 33. Basically, the movement means 14 are designed to position the piston 13 in a dosing position, located between the lower position and the upper position, at the outfeed zone of the region R1 for forming the dose 33, to define the dose 33 in conjunction with the levelling element 22

Preferably, in the embodiment illustrated, the filling station SR comprises a substation ST4 for compacting the dose 33.

The substation ST4 for compacting the dose 33 is positioned in a compacting region R4, along the second movement path P1 of the first seat S1 between the forming substation ST1 and the transfer substation ST2. The substation ST4 is optional and can be omitted.

More specifically, the compacting substation ST4 is equipped with compacting means 11 designed to compress the product, in phase with the piston 13, inside the first seat S1.

The compacting means 11 are described below in more detail.

In the example described, the compacting means 11 comprise a compacting element 28.

The compacting element 28 in the preferred embodiment illustrated comprises a compacting disk 23.

It should be noted that the compacting element 28 is connected to the (carried by the) frame 29 of the filling station SR.

The compacting element 28 is positioned on top of the first seats S1 at the compacting region R4.

It should be noted that the compacting element 28 comprises an upper face and a lower face. Preferably, the lower face is a planar face.

It should be noted that the lower face of the compacting element 28 defines, at the compacting region R4, an upper contact element of the dose 33 positioned inside the first seat S1, so as to compact the product, when the piston 13 is lifted into a compacting position, which is intermediate between the lower position and the upper position.

In other words, the means 14 for moving the piston 13 are designed to move the piston 13 from the lower position to the compacting position, that is to say, to bring the piston 13 towards the compacting element 28, in the compacting region R4, in such a way as to compact the dose 33.

It should also be noted that, according to an embodiment, the compacting element 28 is stationary relative to the frame 29.

The filling station SR is described below with particular reference to the second seat S2, the transfer substation ST2 and the release substation ST3.

It should be noted that the filling station SR comprises, preferably, a second rotary device 10 to which the second seat S2 is associated (connected).

It should be noted that, more generally, the second rotary device 10 forms the above-mentioned further devices 8 for moving the second seat S2 between the transfer substation ST2 and the release substation ST3 and vice versa.

The second rotary device 10 is configured to rotate about a second axis X2. Preferably, the second axis is parallel to the first axis X1. More preferably, the second axis X2 is vertical.

Preferably, the filling station SR comprises a plurality of second seats S2. It should be noted that the second seat(s) S2 are connected to the second rotary device 10 so as to be rotated by it.

It should be noted that the second rotary device 10 comprises, preferably, a second wheel 10*a*, configured to rotate about the second axis X2, to which the second seats S2 are connected.

It should be noted that, by way of a non-limiting example, the second seats S2 in the embodiment illustrated are moved along a third circular path P2. More generally, the third path P2 is closed. Preferably, the third path P2 lies on a plane (horizontal).

More specifically, it should be noted that each second seat S2 is moved in a complete a rotation about the second axis X2, or more generally, around the third path P2, to the transfer station ST2 (in a transfer region R2) and to the release station ST3 (in a release region R3).

At the transfer region R2 the second seat S2 is positioned above, advantageously immediately above, the first seat S1.

More in detail, when the second seat S2 is positioned above the first seat S1 at the transfer region R2, the piston 13 is driven upwards for pushing the dose 33 of product from the first seat S1 to the second seat S2.

With reference to the second seat S2, it should be noted that preferably this seat is a through seat.

More specifically, the second seat S2 is preferably defined by a through cavity (preferably in the form of a hole). Preferably, the cavity is cylindrical. It should be noted that side walls of the second seat S2 are defined by side walls of the through cavity.

Preferably, the second seat S2 is connected to the second rotary device 10 by means of a rod 27.

According to an embodiment not illustrated, the second seat S2 is fixed to the second rotary device 10, that is, to the second wheel 10*a*.

For this reason, according to this embodiment, the radial position of the second seat S2 is constant relative to the second axis X2.

Preferably, in accordance with this embodiment, the plan extension of the second seat S2 is greater than the plan extension of the first seat S1 (in such a way that whilst the dose 33 of product fully occupies the space of the first seat S1, the dose 33 of product after the transfer does not fully occupy the space of the second seat S2).

It should be noted that the fact that the plan extension of the second seat S2 is greater than plan extension of the first seat S1 allows, in use, the transfer of the dose 33 from the first seat S1 to the second seat S2 in a transfer region R2 which is sufficiently large. This is particularly important for speeds of rotation of the first rotary device 9 and of the second rotary device 10 which are particularly high: in effect, the above-mentioned aspect ensures that the superposing of the second seat S2 on the first seat S1 and, therefore, the transfer of the dose 33 the first seat S1 to the second seat S2 can occur in predetermined angles of rotation of the first and the second rotary elements.

According to the embodiment illustrated, each second seat S2 is movable relative to the second rotary device 10, that is, relative to the second wheel 10*a*.

More specifically, preferably each second seat S2 is movable on a plane at right angles to the second axis X2.

Still more preferably, each second seat S2 is movable at least radially relative to the second axis X2.

It should be noted that the fact that the second seat S2 is movable on a plane at right angles to the second axis X2 makes it possible to extend the extension of the transfer region R2: in other words, it is possible to extend the zone where the second seat S2 superposes the first seat S1.

It should be noted that the transfer of the dose 33 from the first seat S1 to the second seat S2 is not instantaneous but is performed within an angle of rotation of the first rotary device 9 and of the second rotary device 10.

In this regard, it should be noted that the fact that the second seat S2 is movable radially relative to the second rotary device 10 allows a tracking of the first seat S1 during rotation of one or both the rotary devices (9, 10), so that it is possible to keep the second seat S2 superposed on the first seat S1 through an angle of rotation of the first rotary device 9 and the second rotary device 10 which is sufficiently large to allow the dose 33 to be transferred from the first seat S1 to the second seat S2.

In the embodiment illustrated, the plan extension of the second seat S2 may be reduced with respect to the embodiment (not illustrated) wherein the second seat S2 is fixed to the second rotary device 10, that is, to the second wheel 10*a*.

During transfer of the dose 33 from the first seat S1 to the second seat S2 the piston 13 supports the dose 33.

In another alternative embodiment not illustrated, each second seat S2 is movable relative to the second rotary device 10 that is, relative to the second wheel 10*a* both radially and in rotation about axes which are parallel to the second axis X2, that is, about vertical axes. Advantageously, cam means may move the second seats S2 radially and in rotation relative to the second rotary device 10 that is, relative to the second wheel 10*a*.

In this further alternative embodiment not illustrated, each second seat S2 has two degrees of freedom on horizontal planes which allow the second seats S2 to perfectly follow the first seats S1 in the transfer region R2.

In other words, each second seat S2 is exactly superposed on a corresponding first seat S1 in the transfer region R2. In this further alternative embodiment not illustrated, the first seats S1 and the second seats S2 can have a plan extension which is equal.

With reference to the position of the second rotary device 10 and of the transport element 39, it should be noted that, according to the example illustrated, the second rotary device 10 and the transport element 39 are positioned in such a way that a portion of the first path P of the supporting seats 5 is—according to a plan view—superposed on a portion of the third path P2 of the second seats S2.

Preferably, the superposed portions of the path between supporting seats 5 and second seats S2 are curvilinear portions of the path (preferably arcs).

It should be noted that, according to this aspect, the release of the dose 33 from the second seat S2 to the rigid, cup-shaped container 2 occurs at the superposed portions of path.

For this reason, the release substation ST3 is positioned at the portions of the path superposed.

It should be noted that, according to an embodiment not illustrated, the transfer of the dose 33 from the second seat S2 to the rigid, cup-shaped container 2 might also occur at a rectilinear portion of the first movement path P of the supporting seats 5, that is to say, a rectilinear portion of the movement line 4 of the rigid, cup-shaped container 2.

Preferably, according to this embodiment, the second seats S2 are movable at least radially relative to the second wheel 10*a*, in such a way as to maintain the superposing of the second seat S2 with the rigid, cup-shaped container 2 at a rectilinear stretch of the line 4 which is sufficiently large.

In other words, according to this embodiment, the movement (at least radial) of the second seat S2 relative to the second wheel 10*a*/second rotary device 10 ensures that the second seat S2, during rotation of the second rotary device 10, remains superposed on the rigid, cup-shaped container 2 being fed in the transport line 4 for a rectilinear stretch sufficiently long to allow the dose 33 to be released from the second seat S2 to the underlying rigid, cup-shaped container 2.

It should be noted that the filling station SR also comprises an upper contact element 25, present in the transfer region R2, which defines an upper stop for the dose 33 (as described in more detail below).

Preferably, the upper contact element 25 is a substantially planar plate.

It should be noted that the upper contact element 25 is fixed to the frame 29 of the filling station SR, that is, it is not rotated as one with the second rotary device 10. More specifically, the upper contact element 25 is positioned in the transfer region R2 above the second seat S2.

The functionality of the upper contact element 25 is described below.

The filling station SR also comprises a supporting element 24 positioned along the third path P2 between the transfer substation ST2 and the release substation ST3.

It should be noted that the supporting element 24 forms a base for each second seat S2, at the portion of the third path P2 where the supporting element 24 is positioned: this will become clearer below, where the operation of the filling unit and the method according to this invention are described.

The filling station SR may comprise, advantageously, according to the embodiment illustrated, one or more pushing elements 26. The pushing elements 26 are optionals and can be omitted. Note: it is basically a rotary ejection device The pushing element(s) 26 is/are movable, the operate(s) on the second seat S2 at the release substation ST3.

In the embodiment illustrated, the filling station SR comprises a pushing element 26 associated with each second seat S2.

For this reason, according to the embodiment illustrated, the filling station SR comprises a plurality of pushing elements 26, one for each second seat S2.

It should be noted that the pushing elements 26 are integral with the second rotary device 10, in such a way as to be rotated with it.

In addition, the pushing element 26 is movable between a raised position, in which it is positioned above and outside the second seat S2, and a lowered position, where it protrudes below the second seat S2. Advantageously, the pushing element 26 may be sized in such a way as to bring about a cleaning of the second seat S2 during the passage from the raised position to the lowered position. The filling station SR comprises drive means, for example cam drive means, for moving the pushing element 26 between the raised position and the lowered position.

Advantageously, the pushing element 26, passing from the raised position to the lowered position, comes into contact with the side of the side walls of the second seat S2, thereby cleaning the side walls.

It should be noted that the pushing element 26 is moved from the raised position to the lowered position at the release substation ST3 (after, or during, the release of the product), in the manner described in more detail below.

It should also be noted that, according to an embodiment, the pushing element 26 pushes, from the top downwards, and towards the outside, the dose 33 positioned inside the second seat S2, with the aim of favouring the transfer of the dose 33 from the second seat S2 to the rigid, cup-shaped container 2.

The release substation ST3 equipped with pushing elements 26 is extremely clean, more so than a station with screw feeders.

It should be noted that, according to an embodiment not illustrated, there is a single pushing element 26 positioned at the release region R3.

This single pushing element 26 is movable in order to make contact—at the end or during the step of releasing the dose 33 from the second seat S2 to the rigid container 2—with the side walls of the second seat S2 so as to carry out a cleaning.

With reference to the filling unit 1 in its entirety, it should be noted that the unit 1 also comprises a unit (formed by one or more electronic cards) for drive and control of the devices (7, 8) for moving, respectively, the first seat S1 and the second seat S2.

The drive and control unit is also configured to control and actuate the advance of the transport element 39 and the movable elements of the filling station SR (for example, the pistons 13, the pushing elements 26).

It should be noted that the drive and control unit coordinates and controls the step of moving all the above-mentioned elements connected to it, so as to allow the operations described below to be performed.

Figure 1:
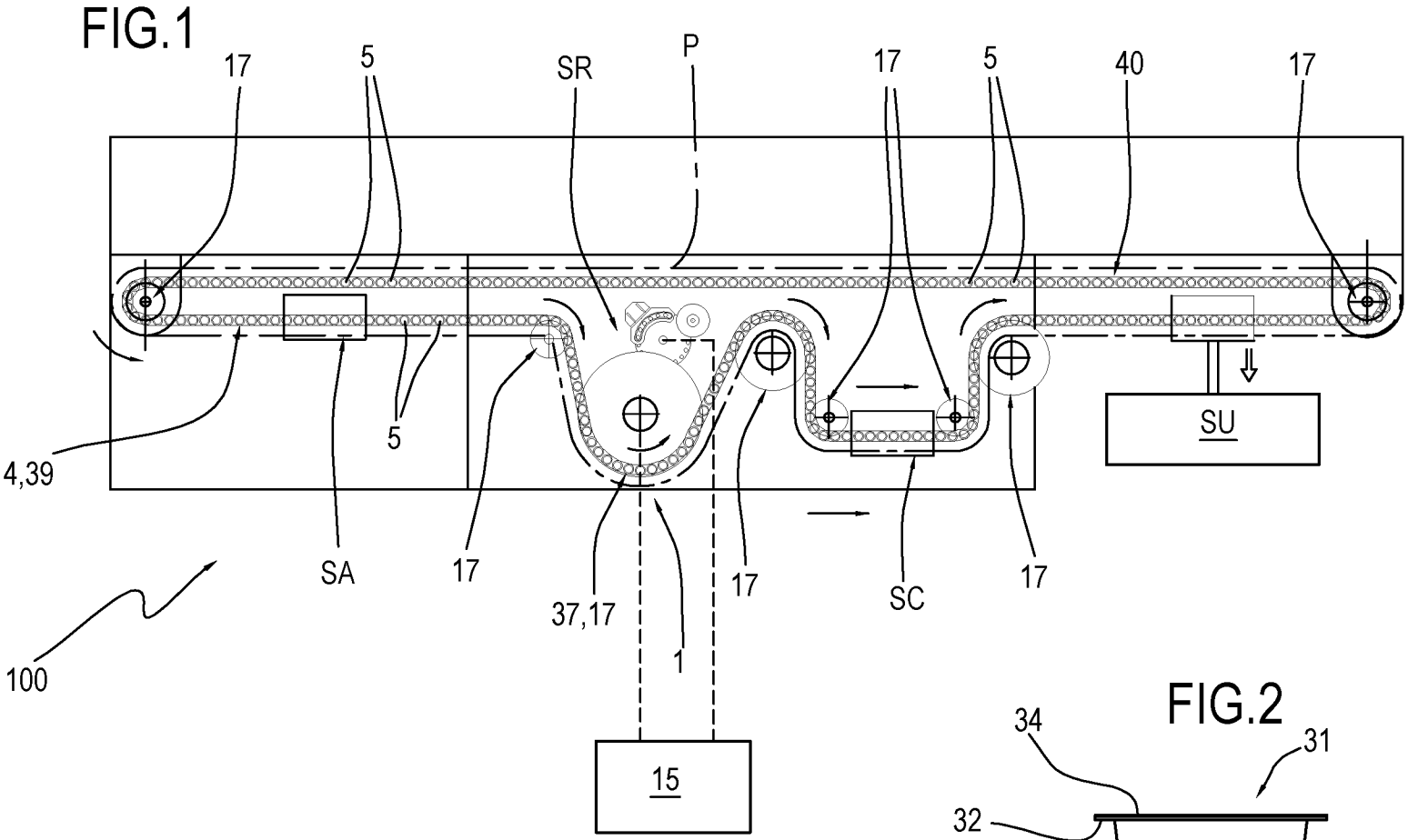
FIG. 1 is a schematic view of a machine for packaging containing elements of single-use capsules for extraction or infusion beverages comprising a filling unit according to a preferred embodiment of the invention.

The filling unit 1 according to the invention may advantageously form part of a packaging machine 100 (illustrated in FIG. 1) designed for packaging single-use capsules for extraction or infusion beverages, for example of the type described above. The packaging machine 100 further comprises a plurality of stations, positioned along the first path P performed by the transport element 39, configured to operate in a synchronised fashion (preferably continuously) with the transport element 39 and with the filling station SR, including at least:

a station SA for feeding rigid containers 2 into corresponding seats 5 of the transport element 39;

a station SC for closing the rigid containers, in particular the upper opening 31 of the rigid container 2, with a lid 34;

an outfeed station which picks up the capsules 3 from the respective seats 5 of the transport element 39.

In addition to the stations listed above (SA, SR, SC, SU), the packaging machine 100 may comprise further stations, such as, for example, one or more weighing stations, one or more cleaning stations, one or more control stations and, depending on the type of capsule to be packaged, one or more stations for applying filtering elements.

The operation of the filling unit 1 is briefly described below, in particular the filling station SR, with the aim of clarifying the scope of the invention: in particular, the filling of a rigid, cup-shaped container 2 is described with reference to the embodiment illustrated in the accompanying drawings. During movement (rotation) of the first rotary device 9, a first seat S1 designed to be filled with a dose 33 of product is positioned in the region R1 for forming the dose 33, that is to say, in the proximity of the station ST1 for forming the dose 33.

It should be noted that the hopper 38 releases the product in the region R1 for forming the dose 33, which falls in, and fills, the first seat S1.

In this regard, the rotary elements (40*a*; 40*b*) are rotated (according to respective speeds of rotation which vary as a function of the angular position of the respective first end E1, as described above) so as to push the product towards the underlying first seats S1.

The movement of the first rotary device 9 is, preferably, a continuous type movement. Alternatively, the movement of the first rotary device 9 is of a step type.

More specifically, the first seat S1 is completely filled at the outfeed of the region R1 for forming the dose 33.

It should be noted that at the outfeed of the region R1 for forming the dose 33, the levelling device 22 allows excess product (for example, powder or leaves) to be removed, in such a way that the first seat S1 is completely filled, or in other words, that the dose 33 comprises a surface formed by the levelling device 22.

Advantageously, the filling unit 1 can operate a step for compacting the dose 33. The compacting step is optional and can be omitted.

In the compacting step, if present, when the first seat S1 is positioned—by the rotation of the first rotary device 9—at the compacting substation ST4, the dose 33 of product inside the first seat S1 is subjected to compacting. More in detail, the dose 33 of product inside the first seat S1 is pushed by the piston 13 upwards when the piston 13 is raised from the lower position to the compacting position, so that an upper part of the dose 33 makes contact with a lower face of the compacting disk 23, and the dose 33 is compacted inside the first seat S1. It is clear that the more the piston 13 is raised, that is to say, moved close to the compacting disk 23, the more the dose 33 is compacted.

Following a further rotation of the first rotary device 9, the first seat S1 is positioned at the transfer region R2, in which the transfer substation ST2 is present.

It should be noted that, due to the rotation of the second rotary device 10, a second seat S2 is positioned at the transfer region R2, for receiving the dose 33 from the first seat S1.

Figure 7:
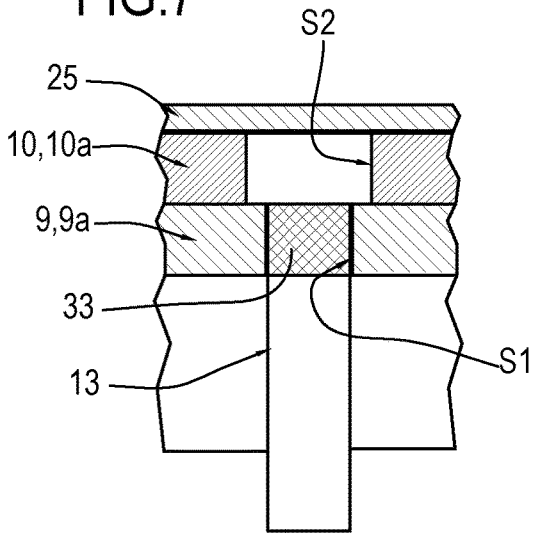
FIGS. 7 to 10 schematically illustrate some operating steps of a method according to the invention performed in the filling station of the filling unit according to the invention.
Figure 8:
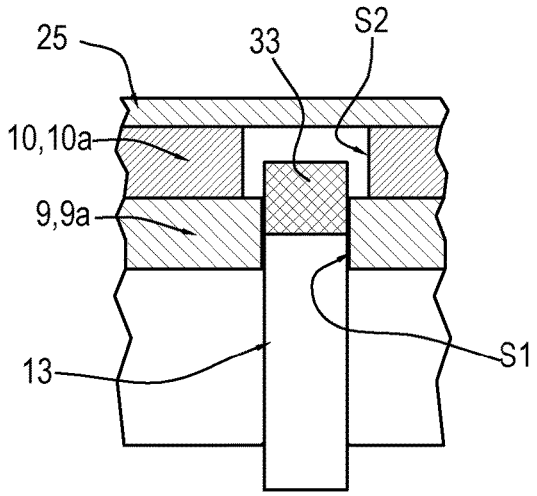
Figure 9:
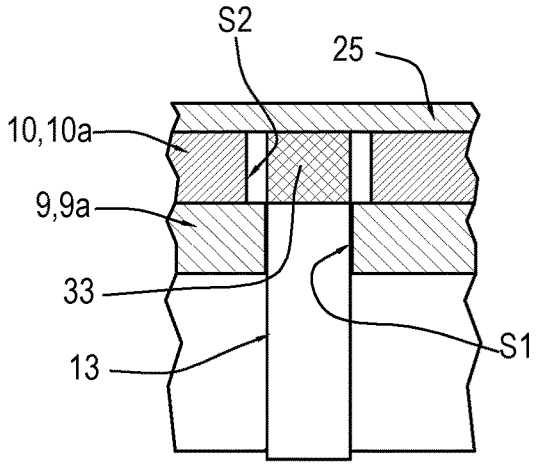
Figure 10:
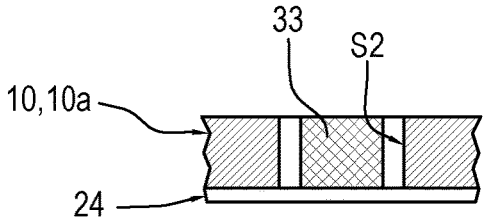

In this regard, FIGS. 7 to 9 illustrate—in a side view—a sequence of operations which are performed at the transfer region R2.

It should be noted that, preferably, the first rotary device 9 and the second rotary device 10 are moved during transfer of the dose 33 of product from the first seat S1 to the second seat S2.

In this regard, during the operating cycle the first rotary device 9 and the second rotary device 10 are, preferably, driven continuously.

It should be noted that, at the transfer region/substation (R2/ST2) the piston 13 is moved from the lowered position, wherein it defines the bottom F the first seat S1, to the raised position, so as to transfer the dose 33 from the first seat S1 to the second seat S2.

In order to perform the transfer, for a period of time depending on the speed of rotation of the respective first and second rotary elements (9, 10), the second seat S2 and the first seat S1 are superposed (at different heights) at the transfer region R2.

In FIGS. 7 to 9, the second seat S2 is located above the first seat S1.

It should be noted that, during transfer from the first seat S1 to the second seat S2 that is, at the transfer region R2, according to a plan view, the area occupied in plan by the first seat S1 is positioned inside the area occupied in plan by the second seat S2 (however, the first seat S1 and second seat S2 are positioned at different heights: the second seat S2 is positioned higher than the first seat S1 as shown in the accompanying FIGS. 7 to 9).

The step of transferring the dose 33 of product from the first seat S1 to the second seat S2 comprises a step for pushing the dose 33, using the piston 13, from the first seat S1 to the second seat S2 (FIG. 8).

It should be noted that the upper contact element 25, present at the transfer region R2, defines an upper stop for the dose 33 of product, in such a way as to substantially prevent the escape of the dose 33 of product from the second seat S2 following the pushing action of the piston 13 (as illustrated in FIG. 9).

The upper contact element 25 is fixed to the frame 29 of the machine, that is, it is not rotated as one with the second rotary device 10.

The piston 13 in the position of escape from the first seat S1 defines, temporarily, the bottom of the second seat S2 that is, it allows the product to be supported inside the second seat S2.

The further rotation of the second rotary device 10 ensures that the second seat S2 makes contact with the bottom of the supporting element 24.

The supporting element 24 therefore replaces the piston 13 in defining the bottom of the second seat S2. At this point, the piston 13 lowers so as to enter the first seat S1.

The first seat S1, following the further rotation of the first rotary device 9, is positioned again at the forming station ST1 of the dose 33, where the piston 13 again adopts the lower position in which it defines the bottom of the first seat S1.

The supporting element 24 is fixed to the frame 29 of the machine, that is, it is not rotated as one with the second rotary device 10.

For this reason, the dose 33, positioned inside the second seat S2, is supported below by the supporting element 24 for a predetermined angular stroke of the second rotary device 10 and moved from the second seat S2 along the third path P2.

In other words, the dose 33 of product inside the second seat S2 slides on, and is supported by, the supporting element 24 for a predetermined angular stroke of the second rotary device 10.

It should be noted that where the supporting element 24 ends there is the release substation ST3. At the release substation ST3, the dose 33 is released from the second seat S2 to a rigid, cup-shaped container 2 positioned, at the release substation ST3, below the second seat S2.

The release substation ST3 extends along a predetermined portion of the third movement path P2 of the second seats S2.

It should be noted that the releasing step is performed preferably whilst the second device 10 is in rotation and the transport line 4 is actuated, that is to say, whilst both the second seat S2 and the rigid, cup-shaped container 2 are moved.

The release step is described below.

It should be noted that, during the release, the second seat S2 is superposed on the cup-shaped container 2, so that it is possible to transfer—by falling, or pushing, from the top downwards—the dose 33 from the second seat S2 to the cup-shaped container 2.

According to a preferred embodiment, the release of the dose 33 from the second seat S2 to the cup-shaped container 2 is achieved simply by dropping the dose 33 by gravity once the second seat S2 is superposed on the cup-shaped container 2, and the supporting element 24 has ended and no longer supports the dose 33.

Moreover, during this releasing step or immediately after, the pushing element 26 penetrates—from the top downwards—into the second seat S2, in such a way as to scrape the side walls of the second seat S2 in order to exert a cleaning action.

If the simple force of gravity is insufficient to allow the transfer of the dose 33, the pushing element 26 may exert a pushing action—from the top downwards—on the dose 33 of product inside the second seat S2, in such a way as to favour the escape of the dose 33 from the second seat S2 and allow the falling, that is, the release, inside the rigid, cup-shaped container 2.

It should be noted that, according to this aspect, the pushing element 26 penetrates—from the top—inside the second seat S2, pushing the dose 33 from the top downwards towards the rigid, cup-shaped container 2.

The action of the pushing element 26 therefore substantially has, in this case, a dual purpose: a cleaning of the second seat S2 and the detachment and therefore the falling of the dose 33 of beverage from the second seat S2 to the rigid, cup-shaped container 2.

Next, the pushing element 26 is again moved towards the raised position, in such a way as to disengage the second seat S2 which is moved, by the rotation of the second rotary device 10, towards the transfer substation ST2, so as to receive a new dose 33 of product.

Preferably, the second rotary device 10, during all the steps described above, is also driven substantially continuously.

Alternatively, both the first rotary device 9 and the second rotary device 10 may be operated in a step-like fashion. In the embodiment wherein the first rotary device 9 and the second rotary device 10 are driven in a step-like fashion, the step of transferring the dose 33 from the first seat S1 to the second seat S2 is performed with the first rotary device 9 and the second rotary device 10 stationary.

After the release in the rigid, cup-shaped container 2, the dose 33 inside the rigid cup-shaped container is moved, by the movement of the transport line 4, towards successive stations, comprising for example, the closing station SC (not described in detail).

It should be noted that the filling unit 1 according to this invention is particularly simple in terms of construction and at the same time is extremely flexible, and can easily adapt to different types of products and capsules.

According to the invention, a method is also defined for filling containing elements of single-use capsules for extraction or infusion beverages. As stated above, the term "containing elements" is deemed to mean both rigid, cup-shaped containers 2, of the type shown, and elements for filtration or retention of a dose of product connected to a rigid container.

The method according to the invention comprises the following steps:

- moving a succession of containing elements 2 along a first movement path P;
- rotating at least one rotary element (40*a*; 40*b*) having a helical profile which extends between a first end E1 and a second end E2 about a respective axis (X4; X5) of rotation positioned angularly inclined to a horizontal plane, for creating a feed flow of product from the second end E2 towards the first end E1 which intercepts a first containing seat S1 to be filled,
- controlling and modifying the speed of rotation of the at least one rotary element 40*a* as a function of the angular position of the first end E1 of the helical profile;
- releasing a dose (33) of product in the first containing seat (S1) movable along a second movement path (P1) in a region (R1) for forming the dose;
- moving the first containing seat S1 from the dose forming region R1 to a dose transfer region R2;
- transferring, at the dose transfer region R2, the dose 33 of product from the first containing seat S1 to a second containing seat S2;
- moving the second containing seat S2 from the dose transfer region R2 to a dose release region R3;
- transferring, at the dose release region R3, the dose 33 of product from the second containing seat S2 to a containing element 2 advancing along the first movement path P and positioned at the dose release region R3.

Preferably, the above-mentioned step of rotating at least one rotary element (40*a*; 40*b*) comprises the steps of:

- rotating a first rotary element 40*a* having a helical profile which extends between a first end E1 and a second end E2 about a respective axis X4 of rotation positioned angularly inclined to a horizontal plane, for creating a feed flow of product from the second end E2 towards the first end E1 which intercepts a first containing seat S1 to be filled;
- rotating a second rotary element 40*b* having a helical profile which extends between a first end E1 and a second end E2 about a respective axis X5 of rotation positioned angularly inclined to a horizontal plane, for creating a feed flow of product from the second end E2 towards the first end E1 which intercepts a first containing seat S1 to be filled;
- controlling the speed of rotation of the first rotary element 40*a* and the second rotary element 40*b* so as to modify the speed of rotation of each rotary element (40*a*; 40*b*) as a function of the angular position of the first end E1 of the helical profile of the rotary element (40*a*; 40*b*).

Again, preferably, the rotation of the first rotary element 40*a* and the second rotary element 40*b* comprises a step of rotating the first rotary element 40*a* and the second rotary element 40*b* at a same frequency of rotation.

Preferably, the rotation of the first rotary element 40*a* and the second rotary element 40*b* comprises a step of rotating the first rotary element 40*a* and the second rotary element 40*b* according to a predetermined phase (angular) relationship.

According to the method, the step of moving a succession of containing elements along a first movement path P preferably comprises moving the containing elements along a first path P which is a closed loop lying on a horizontal plane.

Preferably, the succession of containing elements is moved with continuous motion.

Moreover, the step of moving the first containing seat S1 of the product towards the transfer region R2 comprises a rotation of the first seat S1 about a first vertical axis X1.

According to another aspect, the step of moving the second containing seat S2 of the product from the transfer region R2 to the release region R3 comprises a rotation of the second seat S2 about a second vertical axis X2.

According to yet another aspect, in the step of transferring the dose 33 of product from the first seat S1 to the second seat S2, the second seat S2 and the first seat S1 are superposed (positioned at different heights).

Preferably, in the step of transferring the dose 33 of product from the first seat S1 to the second seat S2, the second seat S2 is positioned above the first seat S1.

Preferably, the step of transferring the dose of beverage from the first seat S1 to the second seat S2 comprises a step of pushing (preferably using a piston 13) the dose 33 from the first seat S1 to the second seat S2.

Preferably, the pushing step comprises pushing the dose 33 from the bottom upwards.

According to another aspect, during the step of moving the first seat S1 from forming region R1 to the transfer region R2, the method comprises a step of compacting the dose 33 inside the first seat S1.

Preferably, the compacting step comprises pushing (preferably using a piston 13) the dose 33 against a compacting element 28 preferably comprising a fixed compacting disk 23, which is rotatable in an idle fashion or rotatable in a motorised fashion about a vertical axis.

According to another aspect of the invention, the method comprises rotating about a respective further axis of rotation X5 a further second rotating element 40*a* to create a recycle flow of product from an exit zone of the region R1 for forming the dose 33 to an internal zone of the same region R1 for forming the dose 33, where the first rotating element 40*a* is positioned.

The method described above is particularly simple and allows the creation of a dose 33 of product and the filling in a fast and reliable manner of a containing element, such as a rigid, cup-shaped container 2, of a single-use capsule 3 for extraction or infusion beverages with the dose 33 of product.

The invention claimed is:

1. A filling unit for filling containing elements of single-use capsules with a dose of product for extraction or infusion beverages, comprising:

a transporting line for transporting the containing elements extending along a first movement path and provided with a plurality of supporting seats for the containing elements arranged in succession along the first movement path, wherein the first movement path is a closed loop on a horizontal plane;

a filling station for filling the containing elements with the dose of product;

a frame wherein the filling station comprises:

at least a first containing seat designed to receive the dose of product;

a forming substation for forming the dose of product inside the at least the first containing seat at a region for forming the dose of product and provided with a releasing device for releasing within the at least the first containing seat a predetermined quantity of product which defines the dose of product, the releasing device comprising a hopper stationary with respect to the frame and at least one rotary element rotationally housed within the hopper and having a helical profile with a first end and a second end, the at least one rotary element being configured for rotating about an axis of rotation, the axis of rotation being stationary with respect to the hopper and positioned angularly inclined and not normal to the horizontal plane, to create a feed flow of product from the second end to the first end of the helical profile, the forming substation being arranged in a first predetermined position with respect to the frame;

at least a second containing seat designed to receive the dose of product from the at least the first containing seat;

a transfer substation for transferring the dose of product from the at least the first containing seat to the at least the second containing seat, the transfer substation being arranged in a second predetermined position with respect to the frame;

moving devices for moving the at least the first containing seat between the forming substation and the transfer substation;

a release substation for releasing the dose of product from the at least the second containing seat to one of the containing elements transported by the transporting line;

further moving devices for moving the at least the second containing seat between the transfer substation and the release substation;

a drive and control unit operatively connected to the at least one rotary element and configured to rotate the at least one rotary element at a speed of rotation that varies as a function of the angular position of the first end of the helical profile of the at least one rotary element, wherein the hopper has a lower portion, stationary with respect to the frame, shaped as a hollow body dimensioned to temporary hold the dose of product coming from the at least one rotary element to create a layer of product to be released into the at least the first containing seat at the region for forming the dose of product, the first end of the helical profile of the at least one rotary element being positioned facing above the lower portion of the hopper, and wherein the at least one rotary element is configured to apply a compressive action on the dose of product within the lower portion of the hopper by rotating the at least one rotary element at the speed of rotation that varies as the function of the angular position of the first end of the helical profile of the at least one rotary element, when the at least the first containing seat transits for a filling time in the region for forming the dose of product, underneath the lower portion of the hopper, and the dose of product is released from the lower portion of the hopper into the at least the first containing seat during the filling time, wherein the lower portion of the hopper has, in cross-section, identical dimension and shape of the at least the first containing seat, and wherein the at least one rotary element is positioned proximal to the at least the first containing seat to be filled so as to apply a compressive action on the product released inside the at least the first containing seat.

2. The filling unit according to claim 1, wherein the drive and control unit is configured to vary the speed of rotation of the at least one rotary element sinusoidally as a function of the angular position of the first end of the helical profile of the at least one rotary element.

3. The filling unit according to claim 1, wherein the at least one rotary element includes a first rotary element and a second rotary element;

and wherein the drive and control unit is operatively connected to the first rotary element and the second rotary element and configured for rotating the first rotary element and the second rotary element according to a respective first rotation speed and a second rotation speed that vary as a function of the angular position of respective first ends of the helical profile of the first rotary element and the second rotary element.

4. The filling unit according to claim 3, wherein the drive and control unit is configured to rotate the first rotary element and the second rotary element according to a predetermined angular phase relationship.

5. The filling unit according to claim 4, wherein the drive and control unit is configured to rotate the first rotary element and the second rotary element according to speeds of rotation which vary sinusoidally.

6. The filling unit according to claim 3, wherein the drive and control unit is configured to rotate the first rotary element and the second rotary element at a same average speed of rotation.

7. The filling unit according to claim 3, wherein:

the first rotary element and the second rotary element are positioned relative to each other in such a way that the first rotary element firstly intercepts the at least the first containing seat when arriving in the region for forming the dose of product;

the drive and control unit is configured to rotate the second rotary element with a second amplitude defined by the difference between maximum and minimum rotation speeds of the second rotary element during each rotation, wherein the second amplitude is different from a first amplitude defined by the difference between maximum and minimum rotation speeds of the first rotary element during each rotation of the first rotary element.

8. The filling unit according to claim 3, wherein the first rotary element and the second rotary element are positioned such that axes of rotation of the first rotary element and the second rotary element are parallel.

9. The filling unit according to claim 3, wherein the drive and control unit is configured to vary the speed of rotation of the first rotary element and the second rotary element sinusoidally at respective phases relative to one another.

10. The filling unit according to claim 9, wherein the phases of the first rotary element and of the second rotary element are 180 degrees out of phase relative to one another.

11. The filling unit according to claim 9, wherein the first rotary element and the second rotary element have different amplitudes defined by the difference between the maximum and minimum rotation speeds of the first rotary element and the second rotary element during each rotation.

12. The filling unit according to claim 1, wherein the at least the first containing seat has a circular shape, in cross-section, having a predetermined diameter, and wherein the lower portion of the hopper for releasing the dose of product to the at least the first containing seat has a width in cross-section substantially equal to the predetermined diameter of the at least the first containing seat.

13. The filling unit according to claim 12, wherein the lower portion of the hopper for releasing the dose of product has a shape of an arc.

14. A packaging machine designed to package single-use capsules for extraction or infusion beverages comprising:

a filling unit according to claim 1;

a station for feeding containing elements of the single-use capsules in corresponding supporting seats of a transporting line of the filling unit;

a station for closing the containing element with a lid so as to form the capsules;

and an outfeed station which picks up the capsules from the supporting seats of the transporting line.

15. A method for filling containing elements of single-use capsules with a dose of product for extraction or infusion beverages, the method comprising the following steps:

moving a succession of containing elements along a first movement path, wherein the first movement path is a closed loop on a horizontal plane;

rotating at least one rotary element having a helical profile with a first end of the helical profile and a second end of the helical profile about an axis of rotation positioned angularly inclined and not normal to the horizontal plane for creating a feed flow of product, from the second end of the helical profile towards the first end of the helical profile;

moving a first containing seat along a second movement path passing through a forming region;

releasing the dose of product in the first containing seat at a dose forming region for forming the dose of product;

moving the first containing seat from the dose forming region to a dose transfer region;

transferring, at the dose transfer region, the dose of product from the first containing seat to a second containing seat;

moving the second containing seat from the dose transfer region to a dose release region;

transferring, at the dose release region, the dose of product from the second containing seat to one of the containing elements advancing along the first movement path;

wherein a hopper has a lower portion shaped as a hollow body dimensioned to temporary hold the dose of product coming from the at least one rotary element to create a layer of product which is released into the first containing seat at the forming region, the first end of the helical profile of the at least one rotary element being positioned facing above the lower portion of the hopper, and wherein the at least one rotary element applies a compressive action on the dose of product within the lower portion of the hopper by rotating the at least one rotary element at a speed of rotation that varies as a function of the angular position of the first end of the helical profile of the at least one rotary element, when the first containing seat transits for a filling time in the forming region, underneath the lower portion of the hopper, and the dose of product is released from the lower portion of the hopper into the first containing seat during the filling time, wherein the lower portion of the hopper has, in cross-section, identical dimension and shape of the first containing seat and said lower portion of the hopper is stationary with respect to a ground, wherein the at least one rotary element is positioned proximal to the first containing seat to be filled so as to apply a compressive action on the product released inside the first containing seat and wherein moving the first containing seat along a second movement path passing through a forming region or moving the first containing seat from the dose forming region to a dose transfer region comprises moving the first containing seat with respect to the ground and keeping the hopper stationary with respect to the ground.

16. The method according to claim 15, wherein the step of rotating the at least one rotary element comprises the steps of:

rotating according to a first speed of rotation a first rotary element having a first helical profile with the first end and the second end of the first helical profile about a first axis of rotation positioned angularly inclined to the horizontal plane, for creating the feed flow of product from the second end of the first helical profile towards the first end of the first helical profile;

rotating according to a second speed of rotation a second rotary element having a second helical profile with a first end of the second helical profile and the second end of the second helical profile about a second axis of rotation positioned angularly inclined to the horizontal plane, for creating the feed flow of product from the second end of the second helical profile towards the first end of the second helical profile;

controlling and modifying the first speed of rotation of the first rotary element and the second speed of rotation of the second rotary element as a function of the angular position of the respective first ends of the first helical profile and the second helical profile.

17. The method according to claim 16, wherein the step of rotating the first rotary element and the second rotary element comprises a step of rotating the first rotary element and the second rotary element at a same average speed of rotation.

18. A filling unit for filling containing elements of single-use capsules with a dose of product for extraction or infusion beverages, comprising:

a transporting line for transporting the containing elements extending along a first movement path and provided with a plurality of supporting seats for the containing elements arranged in succession along the first movement path, wherein the first movement path is a closed loop on a horizontal plane;

a filling station for filling the containing elements with the dose of product;

a frame wherein the filling station comprises:

at least a first containing seat designed to receive the dose of product;

a forming substation for forming the dose of product inside the at least the first containing seat at a region for forming the dose of product and provided with a releasing device for releasing within the at least the first containing seat a predetermined quantity of product which defines the dose of product, the releasing device comprising a hopper stationary with respect to the frame and at least one rotary element rotationally housed within the hopper and having a helical profile with a first end and a second end, the at least one rotary element being configured for rotating about an axis of rotation, the axis of rotation being stationary with respect to the hopper and positioned angularly inclined and not normal to the horizontal plane, to create a feed flow of product from the second end to the first end of the helical profile, the forming substation being arranged in a first predetermined position with respect to the frame;

at least a second containing seat designed to receive the dose of product from the at least the first containing seat;

a transfer substation for transferring the dose of product from the at least the first containing seat to the at least the second containing seat, the transfer substation being arranged in a second predetermined position with respect to the frame;

moving devices for moving the at least the first containing seat between the forming substation and the transfer substation;

a release substation for releasing the dose of product from the at least the second containing seat to one of the containing elements transported by the transporting line;

further moving devices for moving the at least the second containing seat between the transfer substation and the release substation;

a drive and control unit operatively connected to the at least one rotary element and configured to rotate the at least one rotary element at a speed of rotation that varies as a function of the angular position of the first end of the helical profile of the at least one rotary element, wherein the hopper has a lower portion, stationary with respect to the frame, shaped as a hollow body dimensioned to temporary hold the dose of product coming from the at least one rotary element to create a layer of product to be released into the at least the first containing seat at the region for forming the dose of product, the first end of the helical profile of the at least one rotary element being positioned facing above the lower portion of the hopper, and wherein the at least one rotary element is configured to apply a compressive action on the dose of product within the lower portion of the hopper by rotating the at least one rotary element at the speed of rotation that varies as the function of the angular position of the first end of the helical profile of the at least one rotary element, when the at least the first containing seat transits for a filling time in the region for forming the dose of product, underneath the lower portion of the hopper, and the dose of product is released from the lower portion of the hopper into the at least the first containing seat during the filling time, wherein the lower portion of the hopper has, in cross-section, identical dimension and shape of the at least the first containing seat, and wherein the at least one rotary element is positioned proximal to the at least the first containing seat to be filled so as to apply a compressive action on the product released inside the at least the first containing seat, wherein the filling station further comprises a piston slidable mounted within the at least one first containing seat such as to be movable between a lower position wherein the piston defines a bottom wall of the first containing seat and an upper position wherein the piston closes an upper aperture of the at least one first containing seat, the upper aperture communicating with the lower portion of the hopper at the region for forming the dose of product.

* * * * *